United States Patent [19]

Nishio et al.

[11] Patent Number: 5,062,385

[45] Date of Patent: Nov. 5, 1991

[54] OPEN-CELL FOAM DEVELOPING ROLLER

[75] Inventors: Yukio Nishio, Tama; Kazonori Hirose, Hiratsuka, both of Japan

[73] Assignee: Fujitsu Limited, Kawasaki, Japan

[21] Appl. No.: 517,898

[22] Filed: May 2, 1990

[30] Foreign Application Priority Data

May 11, 1989 [JP] Japan ..... 1-118385

[51] Int. Cl.[5] ..... G03G 15/08

[52] U.S. Cl. ..... 118/653; 355/259

[58] Field of Search ..... 355/250, 259; 118/653, 118/656

[56] References Cited

U.S. PATENT DOCUMENTS 4,827,868 5/1989 Tarami et al. ..... 118/653
4,967,231 10/1990 Hosoya et al. ..... 355/259 X

FOREIGN PATENT DOCUMENTS 53-138349 12/1978 Japan .
54-137346 10/1979 Japan .
55-77764 6/1980 Japan .
57-120947 7/1982 Japan .
60-6846 3/1985 Japan .
60-12627 4/1985 Japan .
61-43767 3/1986 Japan .
62-976 1/1987 Japan .
62-96981 5/1987 Japan .
62-118372 5/1987 Japan .
63-100482 5/1988 Japan .
63-189876 8/1988 Japan .
63-231469 9/1988 Japan .

*Primary Examiner*—Joan H. Pendegrass
*Attorney, Agent, or Firm*—Armstrong, Nikaido, Marmelstein, Kubovcik & Murray

[57] ABSTRACT

A developing device using a one-component developer is composed of colored fine synthetic resin toner particles. The device includes a vessel for holding the developer, and a developing roller rotatably provided within the vessel in such a manner that a portion of the roller is exposed therefrom and resiliently pressed against a surface of an electrostatic latent image formation drum. The roller is formed of a conductive open-cell foam rubber material, and a surface thereof is thermally or chemically treated to prevent a penetration of the toner particles to an open-cell foam structure of the developing roller, whereby a softness of the developing roller can be maintained over a long period. The developing device further includes a blade or roller member provided within the vessel and resiliently engaged with the developing roller, for regulating a thickness of the developer layer formed around the developing roller.

31 Claims, 16 Drawing Sheets

OPEN-CELL FOAM DEVELOPING ROLLER

BACKGROUND OF THE INVENTION

1) Field of the Invention

The present invention relates to a developing device used in an electrophotographic field, wherein an electrostatic latent image is visually developed by using a one-component developer.

2) Description of the Related Art

As is well known, an electrophotographic printer carries out the processes of: producing a uniform distribution of electrical charges on a surface of an electrostatic latent image carrying body such as an electrophotographic photoreceptor; forming an electrostatic latent image on the electrically charged surface of the electrophotographic photoreceptor by optically writing an image thereon by using a laser beam scanner, an LED (light emitting diode) array, an LCS (liquid crystal shutter) array or the like; visually developing the electrostatic latent image with a developer, i.e., toner, which is electrically charged to be electrostatically adhered to the electrostatic latent image zone; electrostatically transferring the developed visible image to a paper; and fixing the transferred image on the paper. Typically, the electrophotographic photoreceptor is formed as a photosensitive drum having a cylindrical conductive substrate and a photoconductive insulating film bonded to a cylindrical surface thereof.

In the developing process, a two-component developer composed of a toner component (colored fine synthetic resin particles) and a magnetic component (magnetic fine carriers) is widely used, as it enables a stable development of the latent image. Note, typically the toner particles have an average diameter of about 10 μm, and the magnetic fine carriers have a diameter ten times larger than the average diameter of the toner particles. Usually, a developing device using the two-component developer includes a vessel for holding the two-component developer, wherein the developer is agitated by an agitator provided therein. This agitation causes the toner particles and the magnetic carriers to be subjected to triboelectrification, whereby the toner particles are electrostatically adhered to the magnetic carriers. The developing device also includes a magnetic roller provided within the vessel as a developing roller, in such a manner that a portion of the magnetic roller is exposed therefrom and faces the surface of the photosensitive drum. The magnetic carriers with the toner particles are magnetically adhered to the surface of the magnetic roller to form a magnetic brush therearound, and by rotating the magnetic roller carrying the magnetic brush, the toner particles are brought to the surface of the photosensitive drum for the development of the electrostatic latent image formed thereon.

In this developing device, a ratio between the toner and magnetic components of the developer body held in the vessel must fall within a predetermined range, to continuously maintain a stable development process. Accordingly, the developing device is provided with a toner supplier from which a toner component is supplied to the two-component developer held in the vessel, to supplement the toner component as it is consumed during the development process, whereby the component ratio of the two-component developer held by the vessel is kept within the predetermined range. This use of a two-component developer is advantageous in that a stable development process is obtained thereby, but the developing device per se has the disadvantages of a cumbersome control of a suitable component ratio of the two-component developer, and an inability to reduce the size of the developing device due to the need to incorporate the toner supplier therein.

A one-component developer is also known in this field, and a developing device using the same does not suffer from the above-mentioned disadvantages of the developing device using the two-component developer, because the one-component developer is composed of only a toner component (colored fine synthetic resin particles.) Two types of the one-component developer are known; a magnetic type and a non-magnetic type. A developing device using the magnetic type one-component developer can be constructed in substantially the same manner as that using the two-component developer. Namely, the magnetic type one-component developer also can be brought to the surface of the photosensitive drum by a rotating magnetic roller as in the developing device using the two-component developer. The magnetic type one-component developer is suitable for achromatic color (black) printing, but is not suitable for chromatic color printing. This is because each of the toner particles of which the magnetic type one-component developer is composed includes fine magnetic powders having a dark color. In particular, the chromatic color printing obtained from the magnetic type one-component developer appears dark and dull, due to the fine magnetic powders included therein. Conversely, the non-magnetic type one-component developer is particularly suitable for chromatic color printing because it does not include a substance having a dark color, but the non-magnetic type one-component developer cannot be brought to the surface of the photosensitive drum by the magnetic roller as mentioned above.

A developing device using the non-magnetic type one-component developer is also known, as disclosed in U.S. Pat. Nos. 3,152,012 and 3,754,963. This developing device includes a vessel for holding the non-magnetic type one-component developer, and a conductive elastic solid roller provided within the vessel as a developing roller in such a manner that a portion of the elastic roller is exposed therefrom and can be pressed against the surface of the photosensitive drum. The conductive elastic solid developing roller may be formed of a conductive silicone rubber material or a conductive polyurethane rubber material, as disclosed in Japanese Examined Patent Publication (Kokoku) No. 60-12627 and Japanese Unexamined Patent Publications (Kokai) No. 62-118372 and No. 63-189876. When the conductive solid rubber roller is rotated within the body of the non-magnetic type one-component developer held by the vessel, the toner particles composing the non-magnetic type one-component developer are frictionally entrained by the surface of the conductive solid rubber developing roller to form a developer layer therearound, whereby the toner particles can be brought to the surface of the photosensitive drum for the development of the electrostatic latent image formed thereon. The developing device further includes a blade member engaged with the surface of the developing roller, to uniformly regulate a thickness of the developer layer formed therearound so that an even development of the latent image can be carried out. The blade member also serves to electrically charge the toner particles by a triboelectrification therebetween. In this developing device, the development process is carried out in such a manner that, at the area of contact between the photosensitive drum and the conductive solid rubber developing roller carrying the developer layer, the charged toner particles are electrostatically attracted and adhered to the latent image due to a bias voltage applied to the conductive solid rubber developing roller.

To achieve a proper development of the latent image by the developing rubber roller, an elasticity or hardness of the developing roller is an important parameter, because the development quality and the development toner density are greatly affected by a contact or nip width between the photosensitive drum and the solid rubber developing roller pressed thereagainst. Namely, the developing roller must be pressed against the photosensitive drum so that a given nip width by which a proper development is obtained is established therebetween. The conductive silicone or polyurethane solid rubber developing roller has a relatively high hardness. For example, when measured by an Asker C-type hardness meter, the solid rubber developing roller showed an Asker C-hardness of about 58°. Accordingly, the solid rubber developing roller must be pressed against the photosensitive drum with a relatively high pressure to obtain the required nip width therebetween, but the higher the pressure exerted upon the photosensitive drum by the developing roller, the greater the premature wear of the drum.

Japanese Unexamined Patent Publication No. 63-100482 discloses a developing roller comprising a sponge roller element covered with a silicone solid rubber layer, whereby a penetration of the toner particles into the sponge roller element is prevented. This developing sponge roller is softer than the solid rubber developing roller, and thus the required nip width between the developing roller and the photosensitive drum can be obtained without exerting a high pressure upon the drum. Nevertheless, the production of the sponge developing roller is costly due to the complex construction thereof. Also, this developing roller has a low reliability in operation because the silicone solid layer can be separated from the sponge roller element.

Furthermore, the developing device using the non-magnetic type one-component developer must be constituted in such a manner that the toner particles can be given a charge distribution that will produce a proper development of a latent image, since if this is not ensured, an electrophotographic fog may appear during the development process and the developer be wastefully consumed for the reasons stated hereinafter in detail. Also, the developing device is preferably constituted in such a manner that the charge distribution ensuring a proper development of a latent image is stably obtained without being affected by variations of the temperature and air moisture content.

SUMMARY OF THE INVENTION

Therefore, an object of the present invention is to provide a developing device using a one-component developer, particularly a non-magnetic type one-component developer used in the electrophotographic field, wherein a developing roller for entraining and bringing the developer particles or toner particles to an electrostatic latent image carrying body such as a photosensitive drum or a dielectric drum, to develop a latent image formed thereon, is formed of a conductive open-cell foam rubber material so that the developing roller can be pressed against the electrostatic latent image carrying body with a relatively low pressure to obtain a required nip width therebetween, and an outside peripheral surface of the developing roller is treated to prevent a penetration of the toner particles into an open-cell foam structure of the developing roller.

Another object of the present invention is to provide a developing device as mentioned above, wherein the developing roller is constituted in such a manner that a charge distribution of the toner particles is such that a proper development is obtained.

According to the present invention, there is provided a developing device using a one-component developer, which device comprises: a vessel for holding a one-component developer composed of toner particles; a developing roller rotatably provided within the vessel in such a manner that a portion of the developing roller is exposed therefrom and faces the surface of an electrostatic latent image carrying body; the developing roller being formed of a monolithic conductive open-cell foam elastic material so that an outside peripheral surface thereof is thermally or chemically treated to prevent a penetration of the toner particles into an open-cell foam structure of the developing roller. In the present invention, the monolithic open-cell foam developing roller may be constituted in such a manner that pore openings appear over an outside peripheral surface thereof. Nevertheless, the size of the pore openings is smaller than that of cellular pores inside of the developing roller, and thus the penetration of the toner particles into the open-cell foam structure of the developing roller can be prevented.

The conductive open-cell foam elastic material of which the developing roller is formed may be a conductive open-cell foam polyurethane rubber material, a conductive open-cell foam silicone rubber material, a conductive open-cell foam acrylonitrile-butadiene rubber material or the like. When the toner particles are actively charged by a triboelectrification with the developing roller, this developing roller is preferably made of a conductive polyurethane rubber material which is neutral with regard to frictional electrification, whereby the toner particles can be given a desired distribution for the development of the latent image. The developing roller is resiliently pressed against the surface of the electrostatic latent image carrying body, and may have an Asker C-hardness of at most 50°, preferably 35°, whereby the operating life of the electrostatic latent image carrying body can be prolonged.

The developing device further comprises a developer layer regulating means provided within the vessel and resiliently engaged with the developing roller for regulating a thickness of the developer layer formed around the developing roller. When the developer layer regulating means is formed of a metal material such as aluminum, stainless steel, brass or the like, the developing roller should have an Asker C-hardness of at most 50°, preferably 35°, whereby variations of the developer layer thickness regulated by the developer layer regulating means can be reduced.

When the toner particles are charged by a triboelectrification between the developing roller and developer layer regulating means and the toner particles, the developing roller and developer layer regulating means are constituted in such a manner that a relationship of work functions $W_1$ and $W_2$ thereof and a work function $W_3$ of the toner particles is defined by the following formula:

$$(W_1-W_3)\times(W_2-W_3)>0$$

whereby the toner particles can be given a desired distribution for the development of the latent image. Also, the toner particles may be charged by a triboelectrification between the developer layer regulating means and the toner particles. In this case, the developing roller is constituted so that a work function thereof approximates, preferably conforms with, that of the toner particles, whereby the toner particles can be given a desired charge distribution for the development of the latent image regardless of variations of temperature and air moisture content. Furthermore, when the developer layer regulating means is formed of a conductive material for applying a bias voltage thereto, to prevent the toner particles from being electrostatically adhered to the developer layer regulating means, a charge-injection effect resulting from the application of the bias voltage to the developer layer regulating means may be utilized for charging the toner particles. In this case, a difference between the bias voltage applied to the developer layer regulating means and a developing bias voltage applied to the developing roller should be less than a level at which a high electrical current or an electrical discharge occurs between the developer layer regulating means and the developing roller.

BRIEF DESCRIPTION OF THE INVENTION

The other objects and advantages of the present invention will be better understood from the following description, with reference to the accompanying drawings in which:

FIG. 1 is a schematic view showing an embodiment of a developing device according to the present invention;

FIGS. 2(*a*), 2(*b*), and 2(*c*) are partially enlarged schematic sectional views showing embodiments of a conductive open-cell foam elastic developing roller incorporated into the developing device of FIG. 1;

Figure 18:
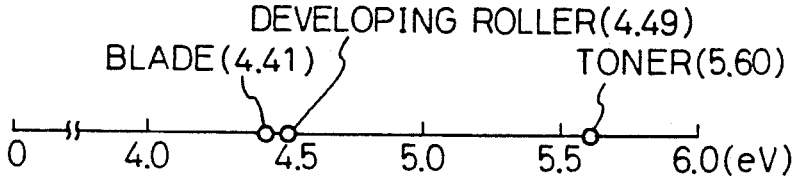
FIG. 18 is a work function scale for comparing the work functions of the conductive open-cell foam polyurethane rubber developing roller, the aluminum blade member, and another type of polyester resin-based toner particles.
Figure 19A:
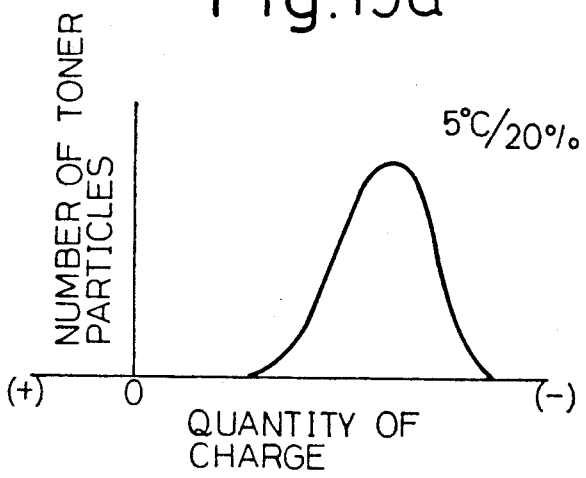
Figure 19B:
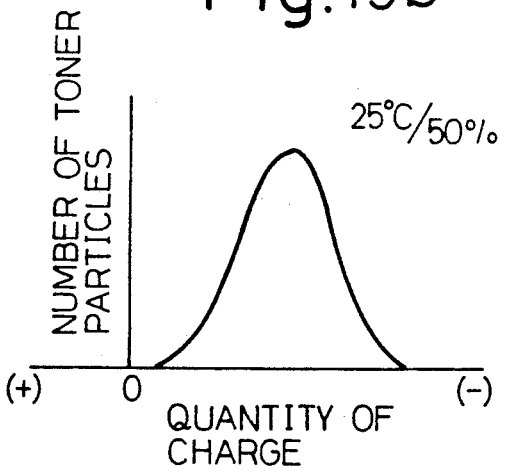
Figure 19C:
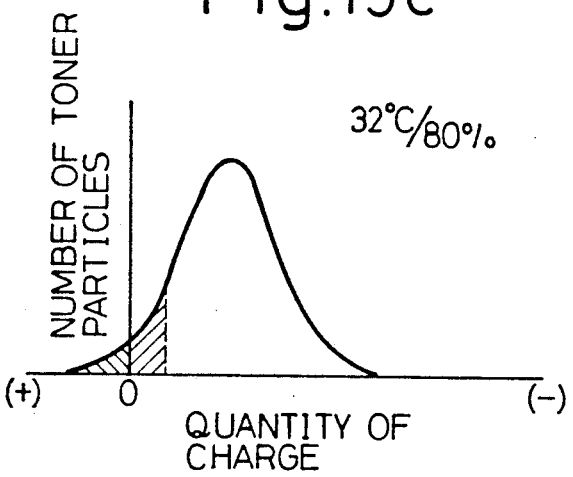
Figure 20:
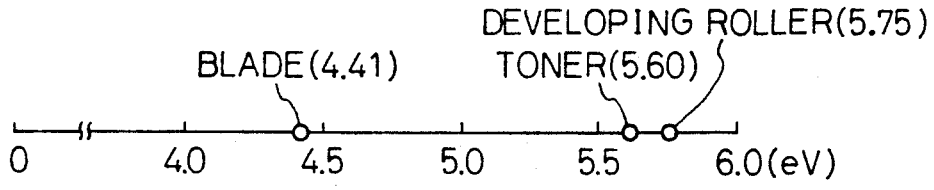
Figure 21A:
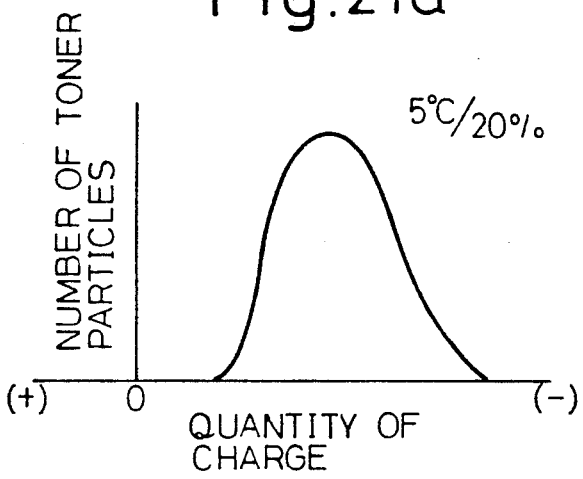
Figure 21B:
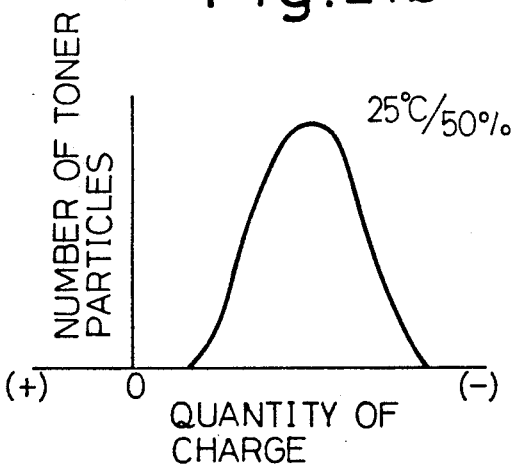
Figure 21C:
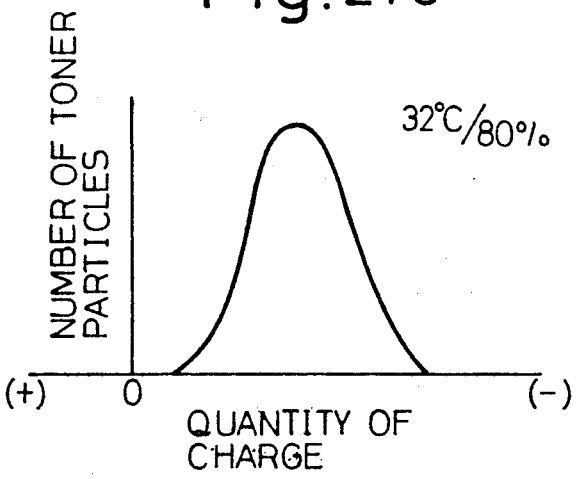
Figure 22:
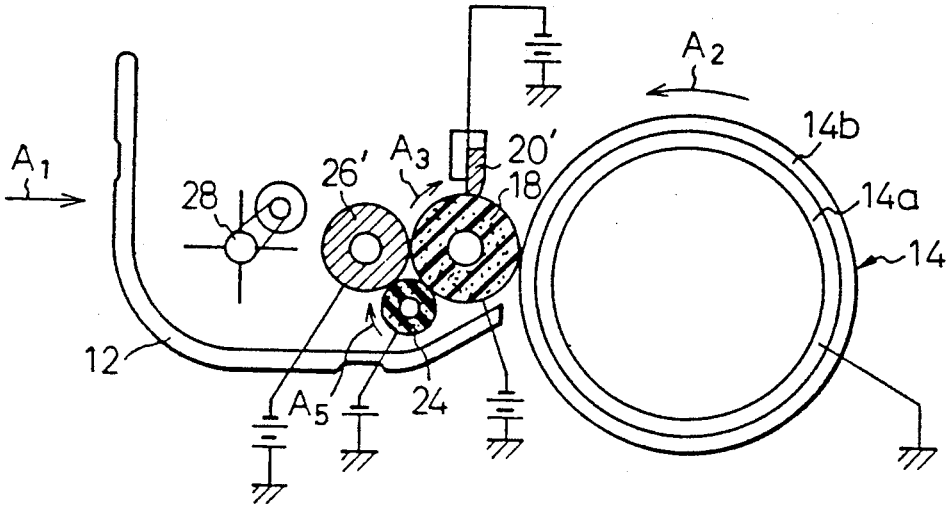
Figure 23:
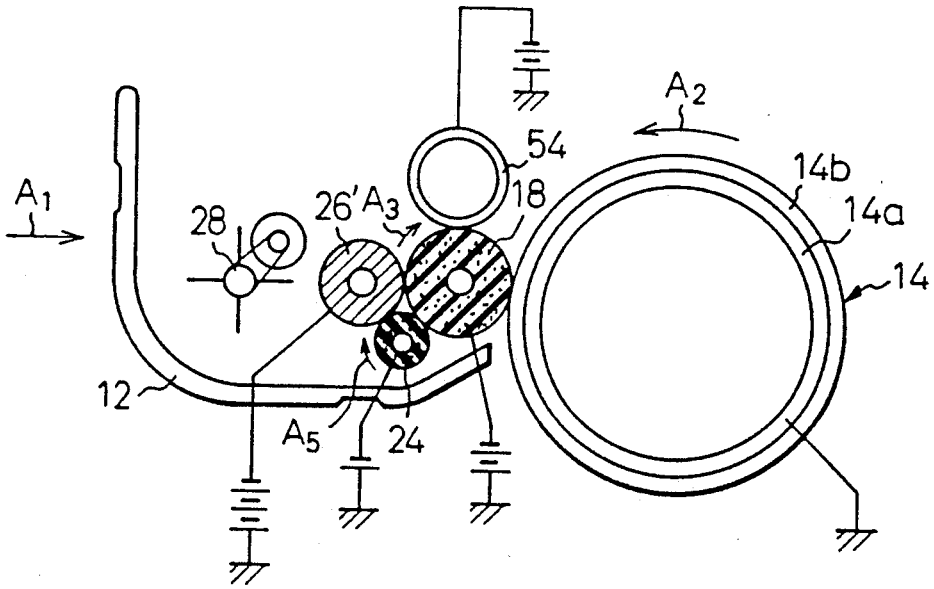
Figure 24:
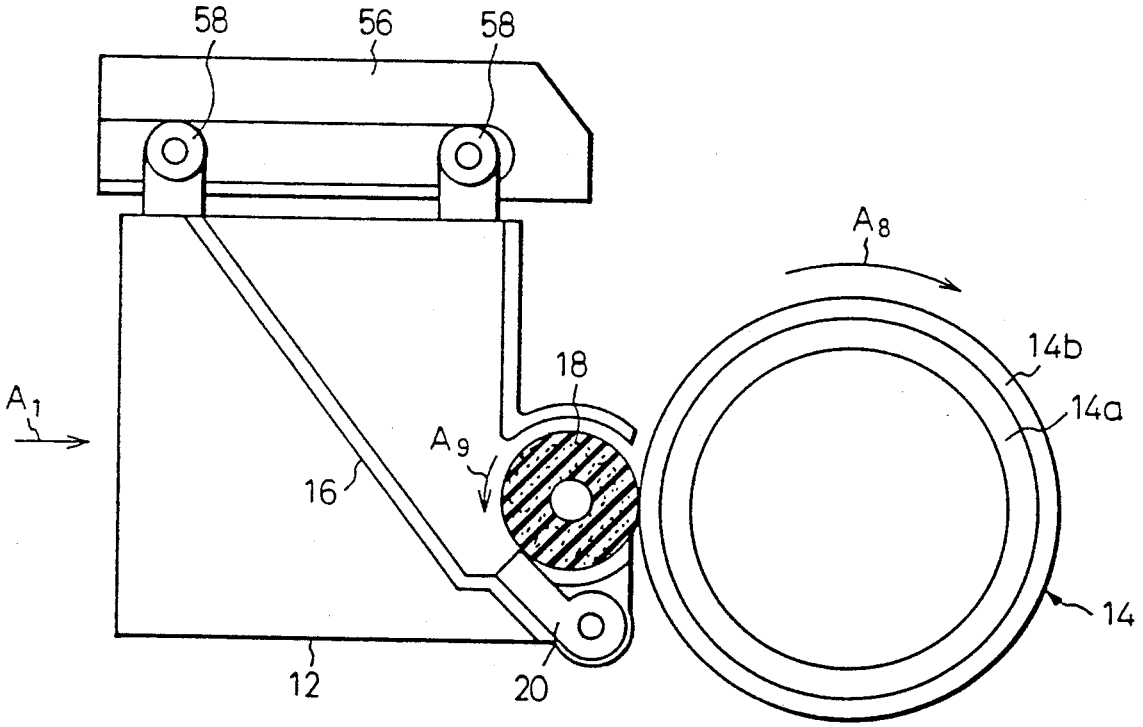
Figure 25:
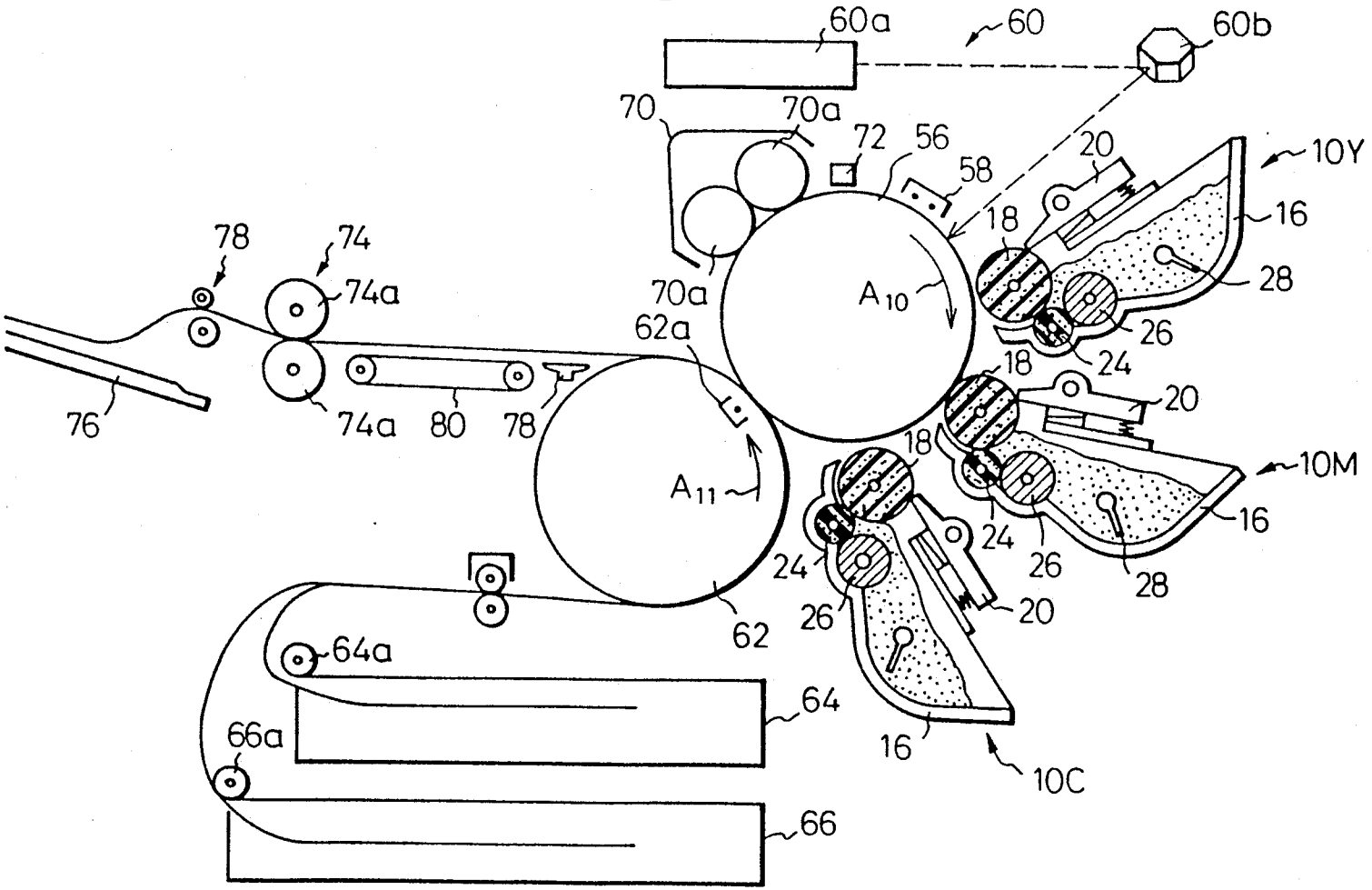

FIGS. 19(*a*), 19(*b*), and 19(*c*) are graphs showing a charge distribution of the polyester resin-based toner particles referred to in FIG. 18 when charged by a triboelectrification while using the conductive open-cell foam polyurethane rubber developing roller;

FIG. 20 is a work function scale for comparing the work functions of a Teflon-coated conductive open-cell foam polyurethane rubber developing roller, the aluminum blade member, and the polyester resin-based toner particles referred to in FIG. 18;

FIGS. 21(*a*), 21(*b*), and 21(*c*) are graphs showing a charge distribution of the polyester resin-based toner particles referred to in FIG. 18 when charged by a triboelectrification while using the aluminum blade member;

FIG. 22 is a schematic view showing another embodiment of a developing device according to the present invention;

FIG. 23 is a schematic view showing a modification of the embodiment shown in FIG. 22;

FIG. 24 is a schematic view showing a further embodiment of a developing device according to the present invention and FIG. 25 is a schematic view showing an electrophotographic color printer including three developing devices according to the present invention, using yellow color, magenta color, and cyan color non-magnetic type one-component developers, respectively.

DESCRIPTION OF THE PREFERRED EMBODIMENTS

Figure 1:
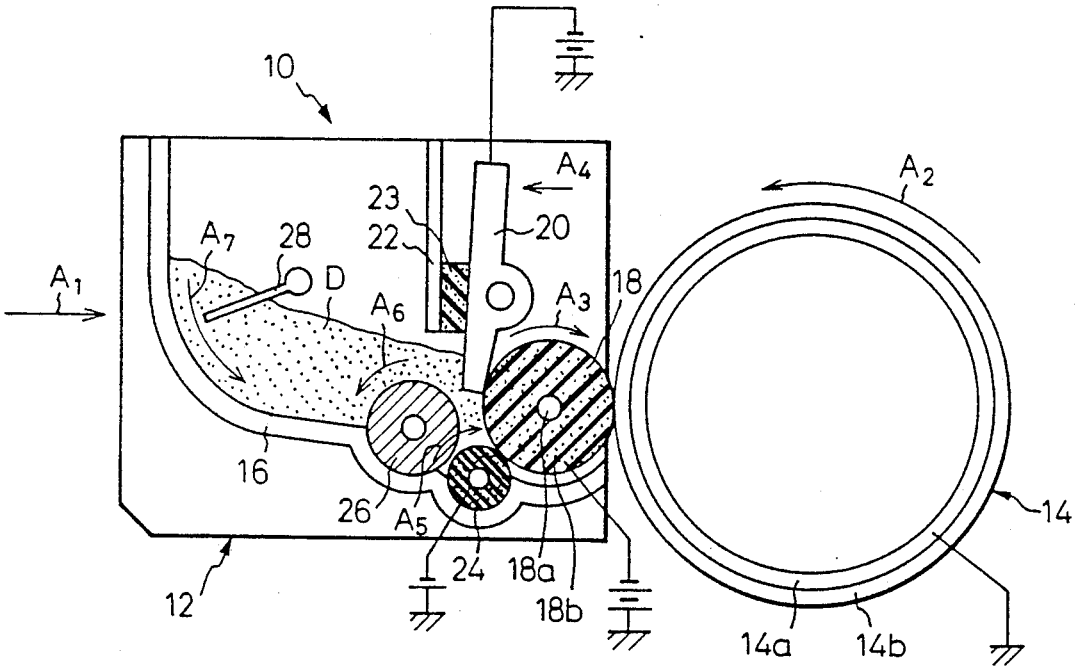

FIG. 1 schematically shows a developing device 10 using a non-magnetic type one-component developer which is intended to be incorporated into an electrophotographic printer (not shown). The developing device 10 comprises a casing 12 supported by a frame structure of an electrophotographic printer (not shown) in such a manner that the casing 12 is movable toward and away from a photosensitive drum 14 forming a part of the electrophotographic printer. The photosensitive drum 14 comprises a sleeve substrate 14*a* made of a conductive material such as aluminum, and a photoconductive material film 14*b* formed therearound. The photoconductive material film 14*b* of the photosensitive drum 14 may be composed of an organic photoconductor (OPC), a selenium photoconductor or the like. A uniform distribution of electrical charges is produced on a surface of the photoconductive material film 14*b* of the photosensitive drum 14 by a suitable discharger (not shown), such as a corona discharger, and an electrostatic latent image is then optically written on the charged surface of the photoconductive material film 14*b* by an optical writing means (not shown such as a laser beam scanner, an LED (light emitting diode) array, an LCS (liquid crystal shutter) array or the like. In particular, when the charged area of the photoconductive material film 14*b* is illuminated by the optical writing means, the charges are released from the illuminated zone through the grounded sleeve substrate 14*a*, so that a potential difference between the illuminated zone and the remaining zone forms the electrostatic latent image. The casing 12 includes a vessel 16 for holding a non-magnetic type one-component developer D composed of colored fine toner particles of a suitable synthetic resin such as polyester or styrene acrylic resin, and having an average diameter of from 5 to 10 μm.

The developing device 10 also comprises a conductive open-cell foam elastic roller 18 rotatably provided within the vessel 16 as a developing roller, a portion of which is exposed therefrom. The casing 12 is resiliently biased in a direction indicated by an arrow $A_1$, by a suitable resilient element (not shown) such as a coil or leaf spring, so that the exposed portion of the developing roller 18 is resiliently pressed against the surface of the photosensitive drum 14. During the operation of the developing device, the photosensitive drum 14 and the developing roller 18 are rotated in the directions indicated by arrows $A_2$ and $A_3$, and the conductive open-cell foam developing roller 18 entrains the toner particles to form a developer layer therearound, whereby the toner particles are brought to the surface of the photosensitive drum 14 may have a diameter of 60 mm and a peripheral speed of 70 mm/s. Further, the developing roller 18 may have a diameter of 20 mm and a peripheral speed of from 1 to 4 times that of the photosensitive drum 14.

Figure 2A:
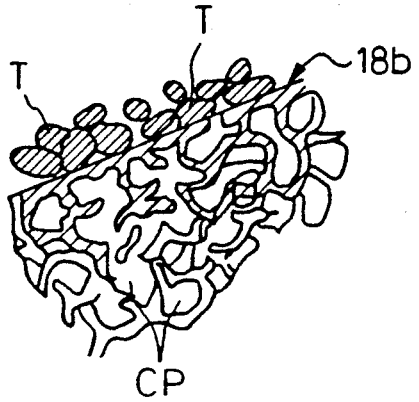
Figure 2B:
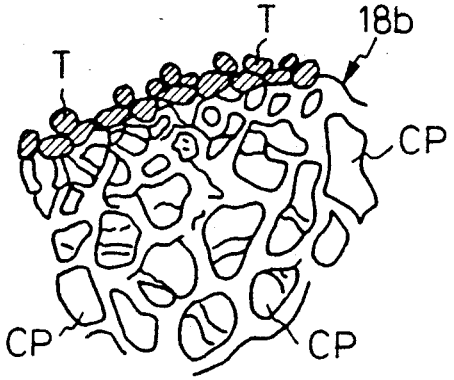
Figure 2C:
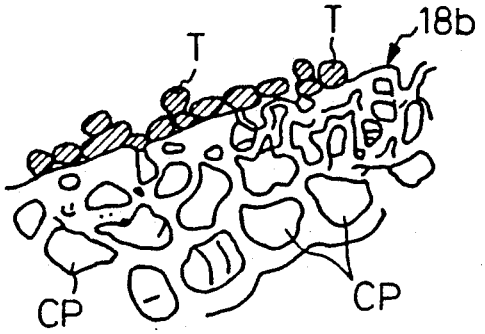

The developing roller 18 comprises a shaft 18*a* rotatably supported by the walls of the vessel 16, and a roller element 18*b* mounted thereon and formed of a conductive open-cell foam rubber material which is based upon polyurethane, silicone, acrylonitrilebutadiene or the like. According to the present invention, as shown in FIGS. 2(*a*), 2(*b*), and 2(*c*), the roller element 18*b* includes a plurality of cellular pores "CP" having a size larger an average diameter of the toner particles "T", and this open-cell foam structure contributes to a high softness of the roller element 18*b*. Furthermore, according to the present invention, an outside peripheral surface portion of the open-cell foam structure is constituted so as to prevent a penetration of the toner particles "T" to an inside of the open-cell foam structure. In particular, in the embodiment of FIG. 2(*a*), the open-cell foam structure of the roller element 18*b* is covered with a solid skin layer by which the penetration of the toner particles "T" into the inside of the open-cell foam structure is firmly prevented; in the embodiment of FIG. 2(*b*), the roller element 18*b* is constituted in such a manner that pore openings appear over a surface thereof, but a diameter of these pore openings is smaller than about 5 μm, so that the penetration of the toner particles "T" to the inside of the open-cell foam structure is substantially prevented; and in the embodiment of FIG. 2(*c*), the roller element 18*b* is constituted in such a manner that pore openings sparsely appear over a surface thereof, and a diameter of these pore openings is smaller than about 5 μm, so that the penetration of the toner particles "T" to the inside of the open-cell foam structure is effectively prevented. Accordingly, the high softness of the developing roller 18 according to the present invention can be maintained over a long period by preventing the penetration of the toner particles to the open-cell foam structure thereof.

The roller element 18*b* may have an Asker-C hardness of from about 10° to 50°, most preferably 10°, because of the open-cell foam structure thereof, and thus it is possible to press the developing roller 18 against the photosensitive drum 14 at a linear pressure of from about 22 to 50 g/cm, most preferably 43 g/cm, so that a contact or nip width of from about 1 to 3.5 mm can be obtained between the developing roller 18 and the photosensitive drum 14. The contact or nip width of from about 1 to 3.5 mm is necessary to ensure a proper development of the latent image. Also, the roller element 18*b* preferably has a volume resistivity of from about $10^4$ to $10^{10}$ Ω·m, most preferably $10^6$ Ω·m.

The developing device 10 further comprises a blade member 20 engaged with the surface of the developing roller 18 to uniformalize a thickness of the developer layer formed therearound, whereby an even development of the latent image is ensured. The blade member 20 is pivotably mounted on a pivot pin supported by the vessel 16, and is resiliently biased in a direction indicated by an arrow $A_4$ so that the blade member 20 is resiliently pressed against the developing roller 18 at a linear pressure of about 26 g/mm, to regulate the thickness of the developer layer formed therearound. The vessel 16 is provided with a partition 22 disposed therein adjacent to the blade member 20, and a stopper member 23 made of a foam rubber material or sponge material is disposed between the partition 22 and the blade member 20, so that the developer D is prevented from entering a space therebetween. The blade member 20 may be formed of a suitable non-conductive or conductive rubber material, but preferably is coated with Teflon, and may be further formed of a suitable metal material such as aluminum, stainless steel, brass or the like. The blade member 20 may also serve to electrically charge the toner particles by a triboelectrification therebetween.

The developing device 10 further comprises a toner-removing roller 24 rotatably provided within the vessel 16 and in contact with the developing roller 18 in such a manner that a contact or nip width of about 1 mm is obtained therebetween, and by which remaining toner particles not used for the development of the latent image are removed from the developing roller 18. The toner-removing roller 24 is formed of a conductive open-cell foam rubber material, preferably a conductive open-cell foam polyurethane rubber material having a volume resistivity of about $10^6$ Ω·m, and an Asker-C hardness of from about 10° to 70°, most preferably 30°. The toner-removing roller 24 is rotated in the same direction as the developing roller 18, as indicated by an arrow $A_5$, whereby the remaining toner particles are mechanically removed from the developing roller 18. For example, the toner-removing roller 24 may have a diameter of 11 mm and a peripheral speed of from 0.5 to 2 times that of the developing roller 18. In the embodiment shown in FIG. 1, the toner-removing roller 24 is partially received in a recess formed in a bottom portion of the vessel 16, whereby a leakage of the toner particles from a space between the developing roller 18 and the vessel bottom can be prevented.

Further, the developing device 10 comprises a paddle roller 26 for moving the toner particles toward the developing roller 18, and an agitator 28 for agitating the developer D to eliminate a dead stock thereof from the vessel 16. The paddle roller 18 and the agitator 28 are rotated in the directions indicated by arrows $A_6$ and $A_7$.

In operation, for example, when the photosensitive film 14*b* of the photosensitive drum 14 is formed of an organic photoconductor (OPC), a distribution of a negative charge is produced thereon, a charged area of which may have a potential of from about −600 to −650 volts. In this case, the latent image zone formed on the drum 14 by the optical writing means may have a reduced potential of about −50 volts. On the other hand, the toner particles are given a negative charge. When the developing roller 18 is rotated within the developer D, the toner particles are frictionally entrained by the surface of the roller element 18*b*, so that the toner particles are carried to the surface of the photosensitive drum 14.

A developing bias voltage of from about −200 to −500 volts is applied to the developing roller 18 so that the toner particles carried to the surface of the drum 14 re electrostatically attracted only to the latent image zone having the potential of about −50 volts, as if the latent image zone were charged with the negative toner particles, whereby the toner development of the latent image is carried out. As mentioned above, the remaining toner particles not used for the development are mechanically removed from the developing roller 18 by the toner-removing roller 24, but the remaining toner particles also can be electrostatically removed from the developing roller 18 by applying a bias voltage of from −150 to −400 volts to the toner-removing roller 24. Since the developer layer formed of the remaining toner particles is subjected to physical and electrical affects during the developing process, it should be removed from the developing roller 18 and a fresh developer layer formed thereon. On the other hand, when the blade member 20 is formed of the conductive material, a bias voltage of from about −200 to −500 volts is applied to the conductive blade member 20 so that the charged toner particles are prevented from being electrostatically adhered to the blade member 20. This is because, when the blade member has an opposite polarity with respect to a potential of the developing bias voltage applied to the developing roller 18, the toner particles are electrostatically adhered to the blade member 20, to thereby hinder an even formation of the developer layer around the developing roller 18. The application of the bias voltage to the blade member 20 may also contribute to the charging of the toner particles by a charge-injection effect.

Note, when the photoconductive material film 14*b* of the photosensitive drum 14 is, for example, composed of a selenium photoconductor, on which a distribution of a positive charge is produced, the toner particles are positively charged and a positive bias voltage is applied to the developing roller 18 and the blade member 20.

The developing roller 18 according to the present invention is especially advantageous when using a developer for a high resolution printing, which is composed of very fine toner particles having an average diameter of about 5 μm. In particular, the cellular pores of the open-cell foam structure of the roller element 18*b* may have a diameter of from about 3 to 20 μm. In this case, although the developing roller is constituted such that pore openings appear over the surface thereof, a usual developer composed of toner particles having an average diameter of about 10 μm can be effectively prevented from penetrating the open-cell foam structure. This is because when two toner particles having the 10 μm diameter are captured by the pore opening having the 20 μm diameter, these toner particles interfere with each other in such a manner that they are prevented from penetrating the open-cell foam structure of the roller element. On the contrary, the toner particles having the 5 μm diameter can easily clear the pore openings having the 20 μm diameter, and thus the penetration of the 5 μm diameter toner particles into the open-cell foam structure of the roller element cannot be prevented. Nevertheless, according to the present invention, as apparent from the descriptions referring to FIGS. 2(*a*), 2(*b*), and 2(*c*), the 5 μm diameter toner particles cannot clear the outside surface portion of the open-cell foam structure of the roller element 18.

The roller element 18*b* according to the present invention may be produced from a roller-shaped intermediate open-cell foam product over an outside peripheral surface in which pore openings appear. In particular, the roller element can be obtained from the intermediate open-cell foam product by thermally or chemically treating the outside peripheral surface thereof, whereby the outside surface portion of the roller element is constituted as shown in FIG. 2(*a*), 2(*b*), and 2(*c*). For example, the outside peripheral surface of the intermediate open-cell product may be thermally treated by a heated blade in such a manner that the surface material thereof is heat-fused, and thus the fused material forms a solid skin layer by which the open-cell foam structure is covered, as shown in FIG. 2(*a*). When the pore openings are partially obturated by the heat-fused material, the peripheral surface portion of the open-cell foam structure is constituted as shown in FIGS. 2(*b*) and 2(*c*). Alternatively, the peripheral surface of the intermediate open-cell product may be chemically treated by a suitable solvent so that the surface portion of the open-cell foam structure is constituted as shown in FIGS. 2(*a*), 2(*b*), and 2(*c*).

In comparison with the production of the developing roller comprising the sponge roller element covered with the silicone solid rubber layer, as disclosed in Japanese Unexamined Patent Publication No. 63-100482, the developing roller according to the present invention can be inexpensively and easily produced. Also, in comparison with this prior developing roller, the developing roller according to the present invention has a higher operational reliability because of a monolithic structure of the roller element thereof. Namely, as mentioned before, in the prior developing roller the silicone solid rubber layer could be separated from the sponge roller element during operation.

Figure 3:
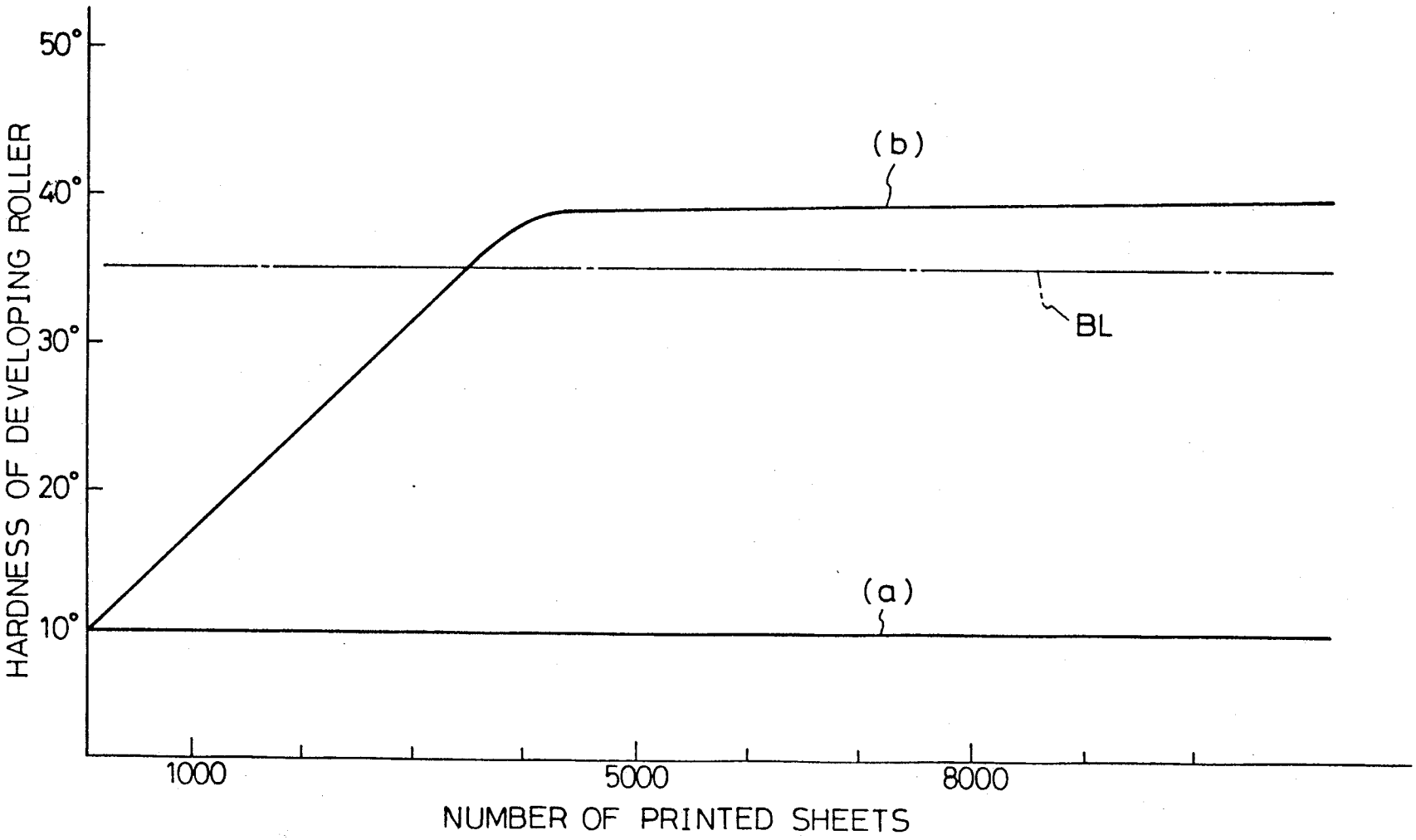
FIG. 3 is a graph showing how a hardness of each of conductive open-cell foam elastic developing rollers having a treated, surface and an untreated surface varies as a number of printed sheets is increased.

FIG. 3 shows how a hardness of developing rollers having the treated surface as mentioned above and an untreated surface, respectively, varies as a number of printed sheets is increased and when using the developer composed of the toner particles having the average diameter of 5 μm. Note, in FIG. 3, characteristics (a) and (b) denote the developing rollers having the treated surface and the untreated surface. As apparent from this drawing, an initial hardness of the developing roller having the treated surface is maintained even after the number of printed sheets exceeds 8,000, which shows that there is no penetration of the toner particles into the open-cell foam structure of the roller element, due to the treated surface thereof. On the other hand, the hardness of the developing roller having the untreated surface is gradually increased until the number of printed sheets reaches about 4,000, and is then constantly maintained. This, of course, means that the roller element has been hardened by the penetration of the toner particles into the open-cell foam structure thereof.

Figure 4:
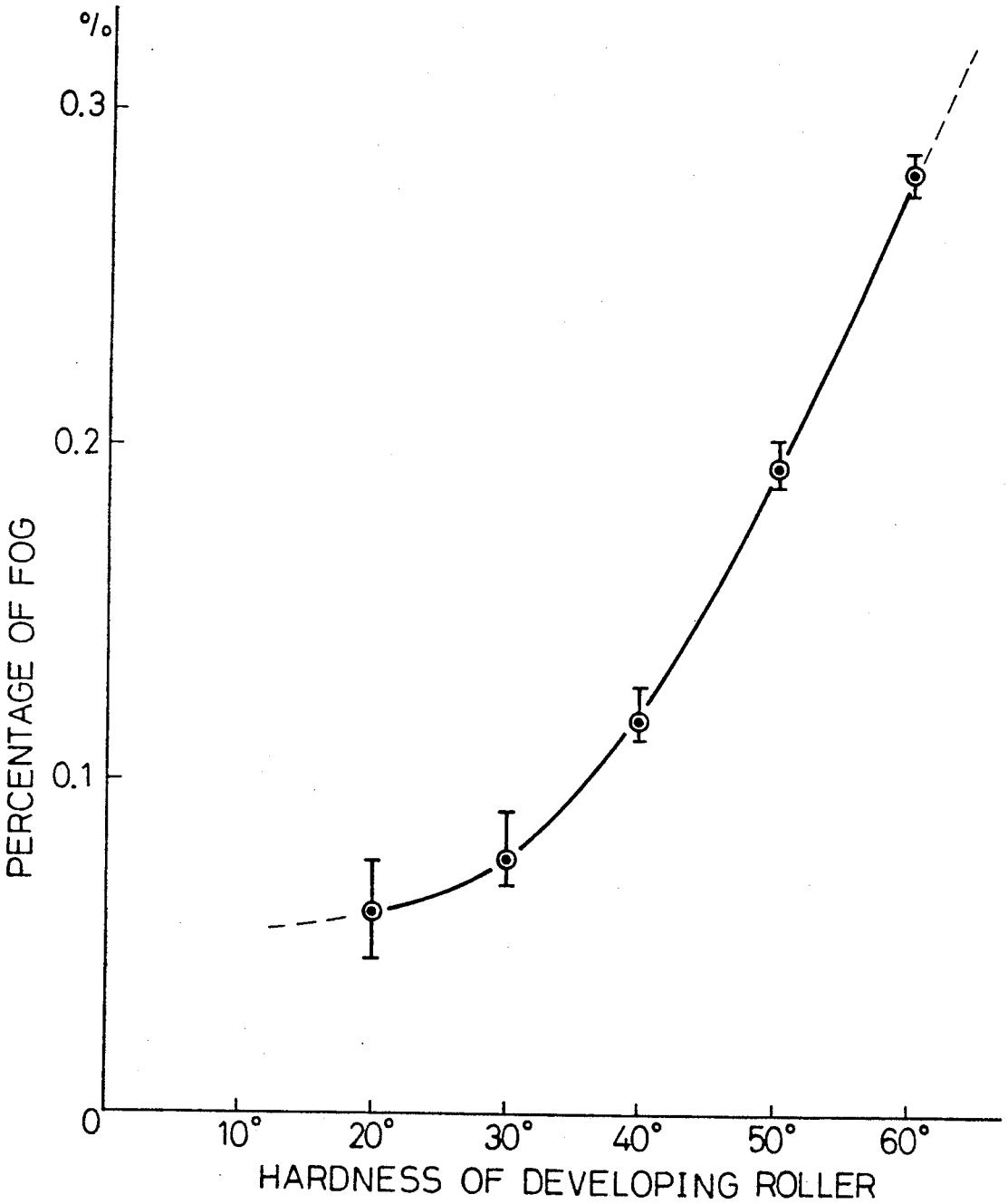
FIG. 4 is a graph showing how a percentage of electrophotographic fog which may appear during the development process varies as the hardness of the conductive open-cell foam elastic developing roller is raised.

As shown in FIG. 4, the larger the hardness of the developing roller, the greater the increase in the percentage of electrophotographic fog. For example, if an electrophotographic fog of 0.1% is permissible, the hardness of the developing roller must be less than an Asker C-hardness of about 35°. When using the developing roller having the untreated surface, the hardness thereof exceeds a border line BL of the Asker C-hardness of about 35° when the number of printed sheets reaches about 3,500.

Figure 5:
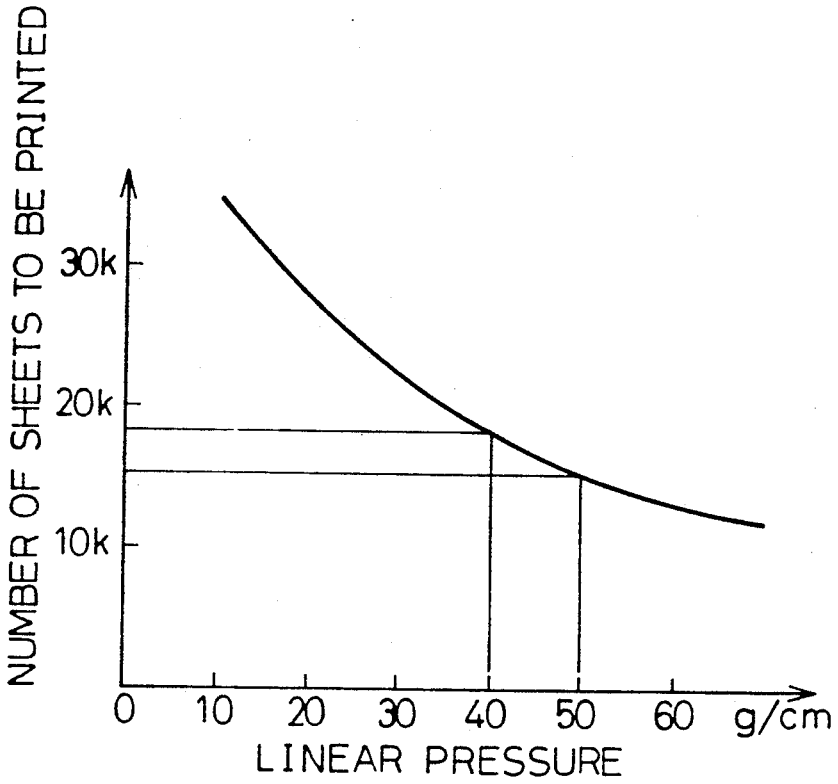
FIG. 5 is a graph showing a relationship between a linear pressure at which the conductive open-cell foam elastic developing roller is pressed against the photosensitive drum and a maximum number of sheets which can be printed by the photosensitive drum.
Figure 6:
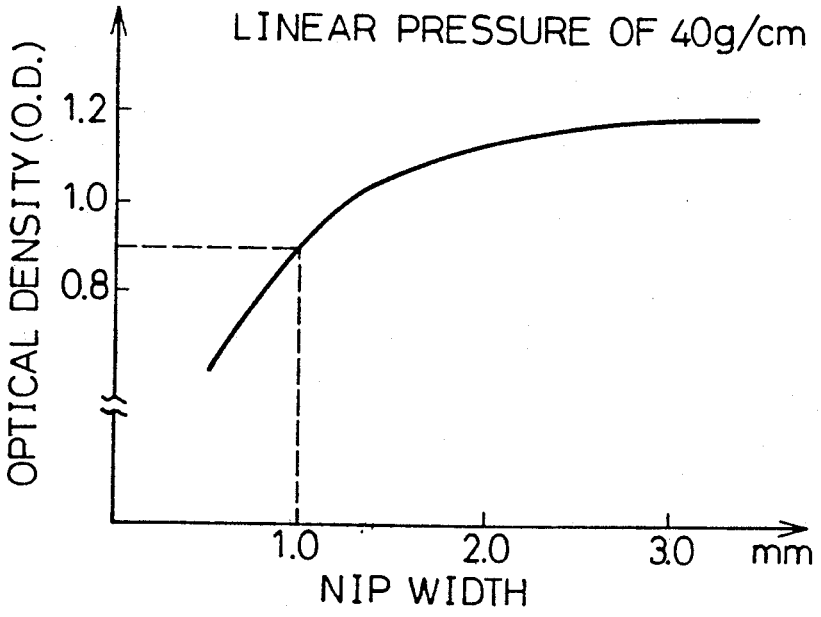
FIG. 6 is a graph showing a relationship between an optical density (O.D.) of a developed image and a contact or nip width between the conductive open-cell foam elastic developing roller and the photosensitive drum.
Figure 7:
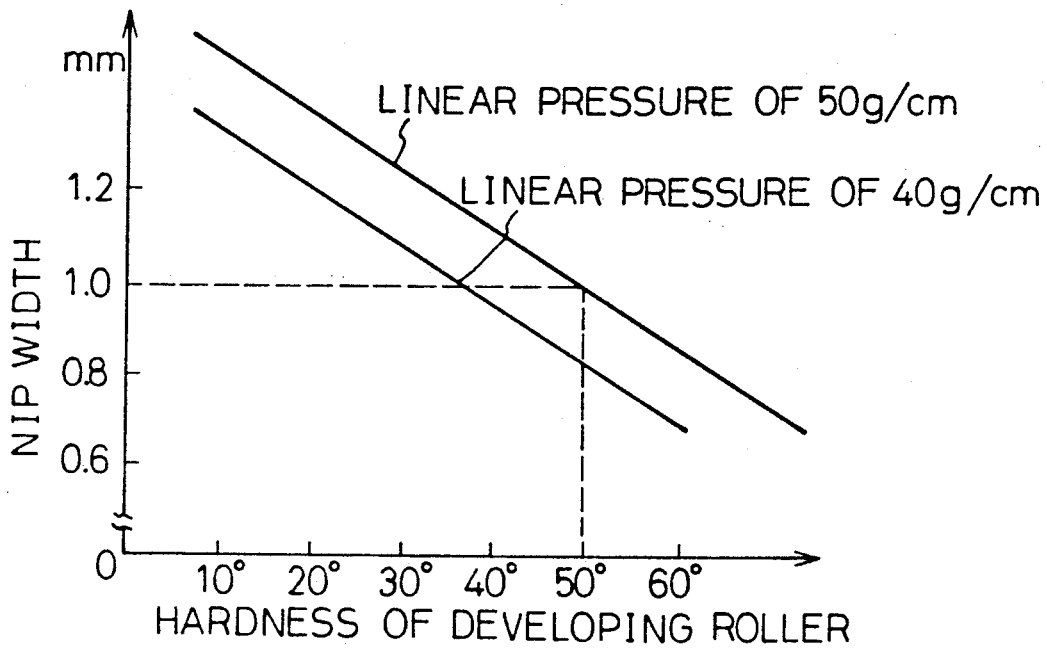
FIG. 7 is a graph showing a relationship between a hardness of the conductive open-cell foam elastic developing roller and a nip width between the porous rubber developing roller and the photosensitive drum.

According to another aspect of the present invention, the developing device 10 is characterized in that the developing roller 18 as mentioned above has an Asker C-hardness of at most 50°, preferably 35°. The harder the developing roller 18, the greater the wear of the photosensitive film **14*b* of the drum 14, whereby the operating life of the drum 14 is shortened. As shown in FIG. 5, the higher the linear pressure at which the developing roller is pressed against the photosensitive drum, the lower the number of sheets which can be printed by the photosensitive drum. For example, when the photosensitive drum is required to withstand a printing of more than 15,000 sheets, the developing roller must be pressed against the drum at a linear pressure of at most 50 g/cm. On the other hand, as shown in FIG. 6, the larger a contact or nip width between the developing roller and the drum, the higher an optical density (O.D.) of the developed image. For example, when the developing roller is pressed against the drum at a linear pressure of 40 g/cm, the nip width therebetween must be at least 1 mm before an optical density of more than about 0.9 necessary for the development process can be obtained. Note, a nip width of more than 1.5 mm is preferable for obtaining a developed image with a required optical density. Also, as shown in FIG. 7**, the lower the hardness of the developing roller, the larger the nip width between the developing roller and the drum. For example, when a developing roller having an Asker C-hardness of 50° is pressed against the drum at a linear pressure 50 g/cm, the nip width therebetween is 1 mm, whereas when a developing roller having an Asker C-hardness of 40° is pressed against the drum at the same linear pressure, the nip width therebetween is 1.1 mm. Accordingly, the Asker C-hardness of the developing roller should be at most 50°, to enable the photosensitive drum to print more than 15,000 sheets. Note, preferably a developing roller having an Asker C-hardness of less than 35° is pressed against the drum in such a manner that the nip width therebetween is from 1 to 3.5 mm.

Figure 8:
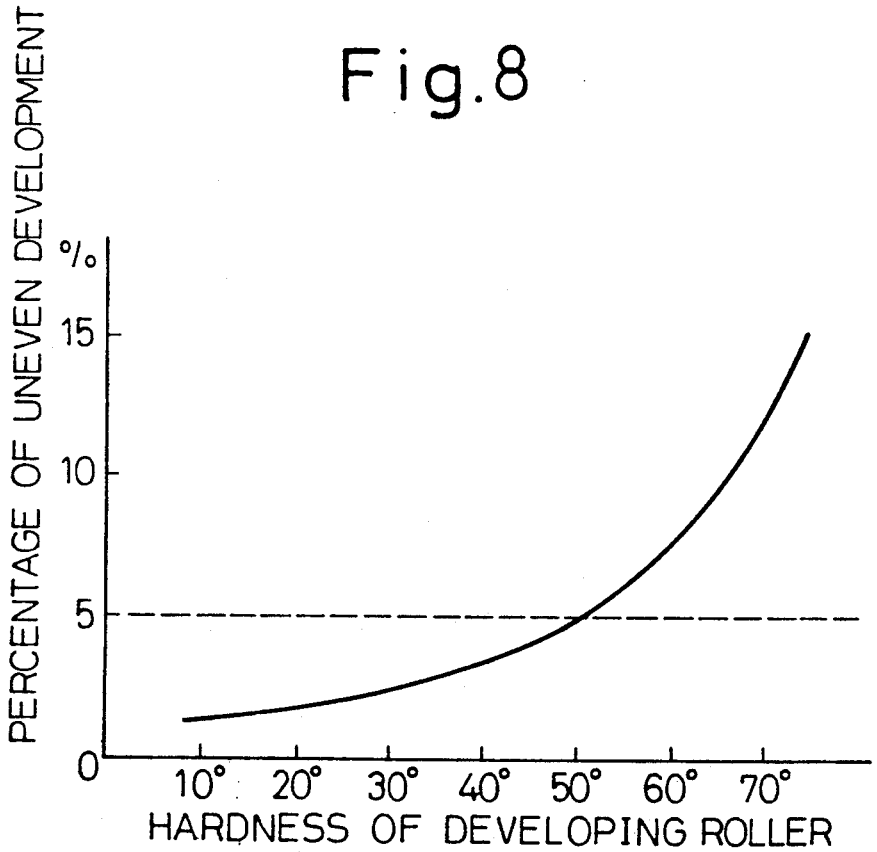
FIG. 8 is a graph showing a relationship between a hardness of the conductive open-cell foam elastic developing roller and a percentage of uneven development.
Figure 9:
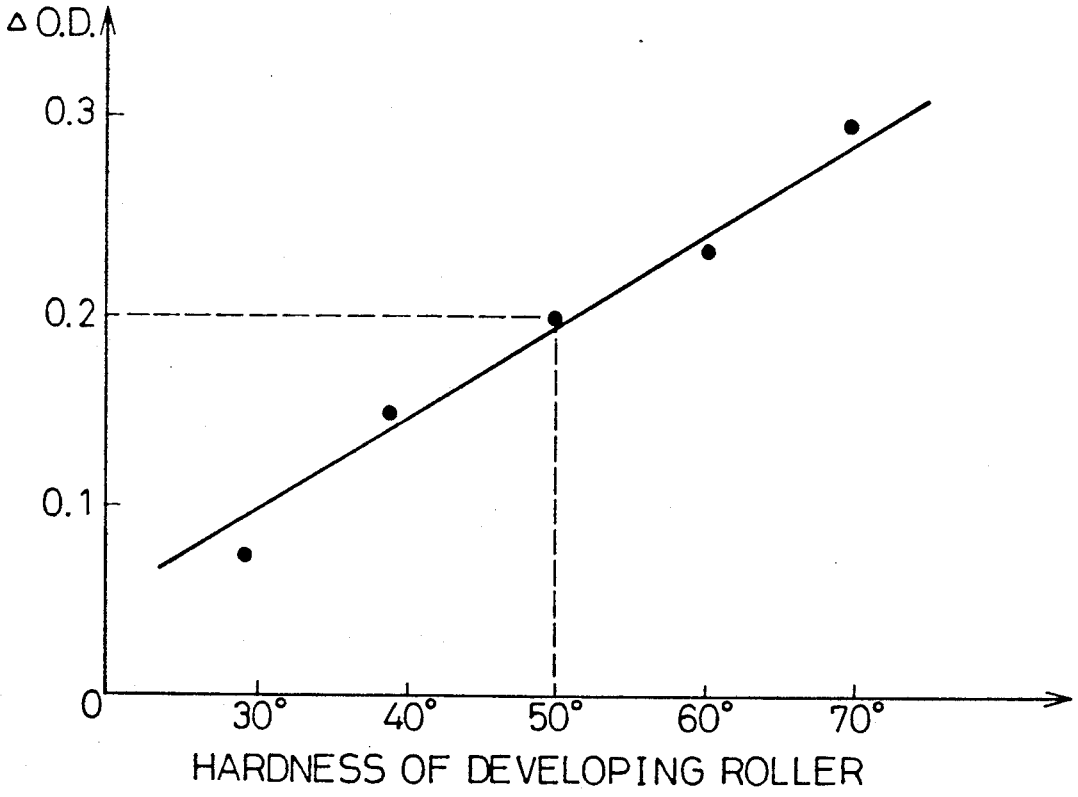
FIG. 9 is a graph showing a relationship between a hardness of the conductive open-cell foam elastic developing roller and a difference between the highest and lowest optical densities (O.D.) when printing a sheet solidly with a black developer.

When the blade member 20 is made of a metal material such as aluminum, stainless steel, brass or the like, the developing roller 18 must have an Asker C-hardness of at most 50°. The metal blade member has a treated and finished surface which is engaged with the developing roller to regulate the thickness of the developer layer formed therearound. In general, a possible accuracy of the finished surface of the metal blade member is on the order of about 30 μm, but this may be rough relative to toner particles having an average diameter of from 0.5 to 10 μm, so that the regulated thickness of the developer layer is made uneven due to the rough surface of the metal blade member, to thereby cause an uneven development of the latent image. The greater the hardness of the developing roller, the greater the variation of the developer thickness, and thus the uneven development becomes more noticeable as shown in FIG. 8. In this drawing, the abscissa shows a hardness of the developing roller, and the ordinate shows a percentage of uneven development when a sheet is printed solidly with a black developer. For example, if an uneven development of at most 0.5%, which is not visually noticeable, is permissible, as indicated by a broken line in FIG. 8, the developing roller must have an Asker C-hardness of at most 50°. Also, FIG. 9 shows a relationship between a hardness of the developing roller and a difference (ΔO.D.) between the highest and lowest optical densities when printing a sheet solidly with a black developer. Similarly, the difference of 0.2 (ΔO.D.), which is not visually noticeable, corresponds to the Asker C-hardness of about 50°, as indicated by broken lines in FIG. 9.

According to a further aspect of the present invention, the developing device 10 is characterized in that the developing roller 18 is formed of the conductive open-cell foam polyurethane rubber material. When the triboelectrification between the developing roller 18 and the toner particles is utilized for charging the toner particles, the developing roller 18 is preferably formed of the conductive open-cell foam polyurethane rubber material, not the conductive open-cell foam silicone rubber material, because the toner particles charged by using the polyurethane foam rubber developing roller can be given a charge distribution that ensures a proper development of a latent image.

Figure 10:
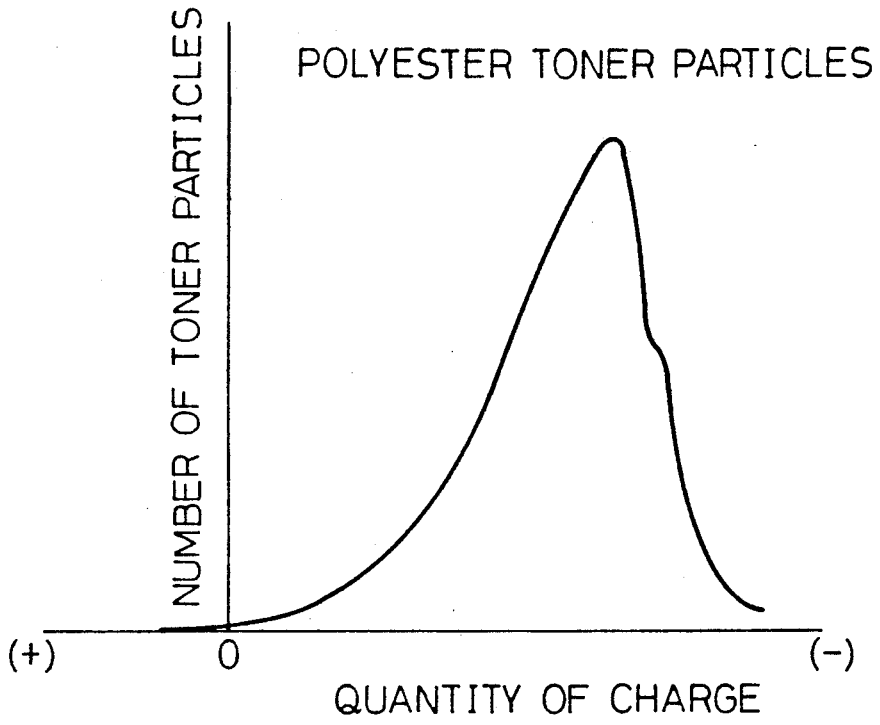
FIG. 10 is a graph showing a charge distribution of polyester resin-based toner particles when being charged by using a conductive open-cell foam polyurethane rubber developing roller.
Figure 11:
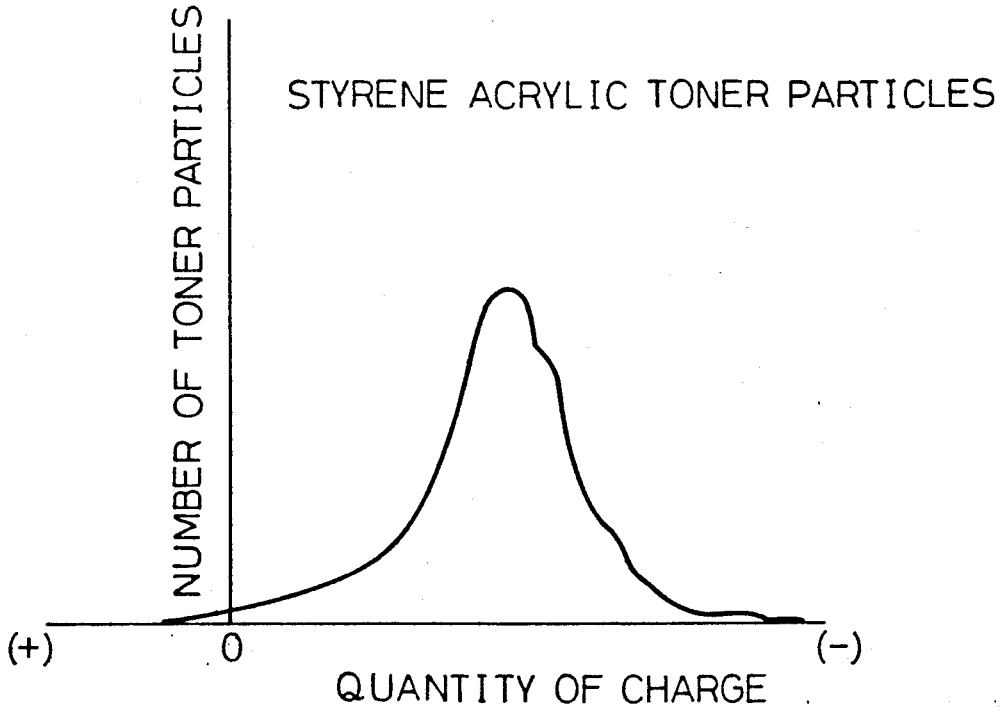
FIG. 11 is a graph showing a charge distribution of styrene acrylic resin-based toner particles when being charged by using the conductive open-cell foam polyurethane rubber developing roller.
Figure 12:
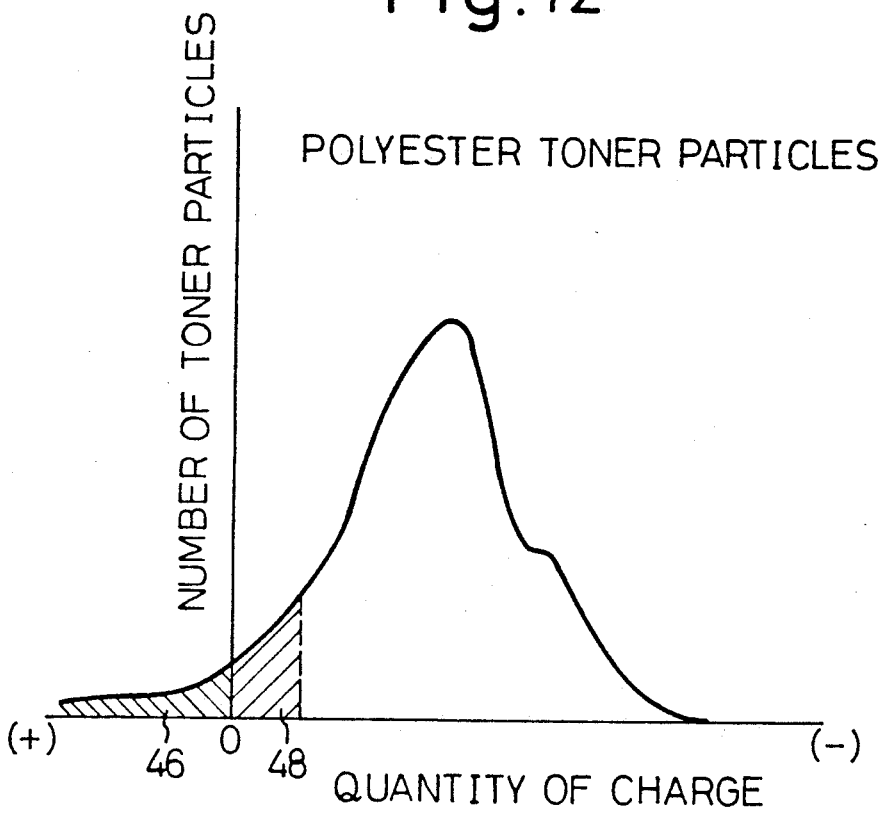
FIG. 12 is a graph showing a charge distribution of the polyester resin-based toner particles when being charged by using a conductive open-cell foam silicone rubber developing roller.
Figure 13:
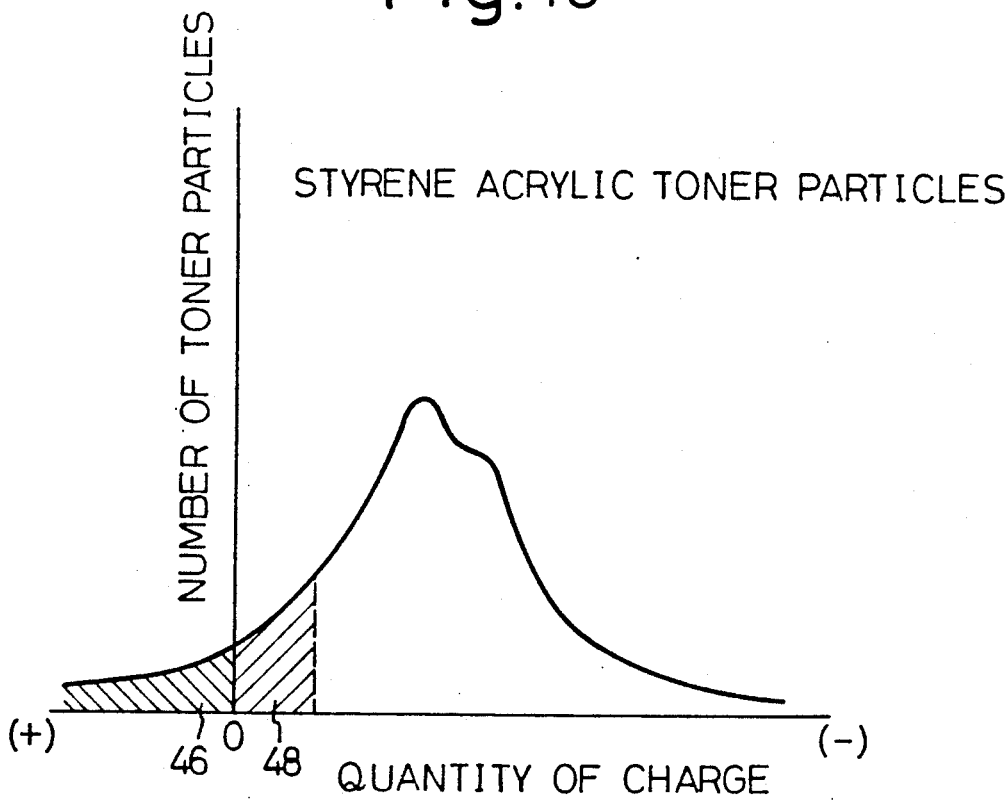
FIG. 13 is a graph showing a charge distribution of the styrene acrylic resin-based toner particles when being charged by using the conductive open-cell foam silicone rubber developing roller.

For example, when the photosensitive drum 14 is formed of the organic photoconductor (OPC), the polyester or styrene acrylic resin-based developer is used so that the toner particles thereof are given a negative charge. FIG. 10 shows a charge distribution of the polyester resin-based toner particles when charged while using the polyurethane foam rubber developing roller, and FIG. 11 shows a charge distribution of the styrene acrylic resin-based toner particles when charged while using the polyurethane foam rubber developing roller. Further, FIG. 12 shows a charge distribution of the polyester resin-based toner particles when charged while using the silicone foam rubber developing roller, and FIG. 13 shows a charge distribution of the styrene acrylic resin-based toner particles when charged while using the silicone foam rubber developing roller. Note, in each of FIGS. 10, 11, 12 and 13, the abscissa and the ordinate indicate a quantity of charge and a number of toner particles, respectively. As apparent from these drawings, when the polyurethane foam rubber developing roller is used, the polyester resin-based and styrene acrylic resin-based developers substantially do not contain toner particles having a positive charge, whereas when using the silicone foam rubber developing roller, the polyester resin-based and styrene acrylic resin-based developers contain not only a positively-charged part of the toner particles indicated by reference numeral 46, but also a low-level negatively-charged part of the toner particles indicated by reference numeral 48. This is assumed to be because the polyurethane foam rubber developing roller is neutral with regard to frictional electrification, whereas the silicone foam rubber developing roller is positive-high with regard to frictional electrification. In particular, the silicone foam rubber developing roller may be overcharged because of the positively-high characteristics thereof with regard to frictional electrification, so that an electrical discharge between the silicone foam rubber developing roller and the blade member 20 may occur, whereby a part of the toner particle is subjected to a positive charge. Note, the charge distributions of the toner particles shown in FIGS. 12 and 13 cannot ensure a proper development of a latent image because the positively-charged toner particles and the low-level negatively-charged toner particles may adhere to the surface of the photosensitive drum, except for the latent image zones, and thus the developer is prematurely consumed. Also, although the positively-charged toner particles adhered to the photosensitive drum cannot be transferred to a sheet or paper, the low-level negatively-charged toner particles can be transferred from the photosensitive drum to the sheet or paper, thereby causing an electrophotographic fog to appear thereon. Accordingly, when the triboelectrification between the developing roller 18 and the toner particles is utilized for charging the toner particles, the roller element 18*b* is preferably formed of the conductive polyurethane foam rubber material.

According to a further aspect of the present invention, the developing device 10 is characterized in that the developing roller 18 and the blade member 20 are constituted in such a manner that the work functions thereof are smaller or larger than that of the developer. When the triboelectrification between the developing roller 18 and blade member 20 and the toner particles is utilized for charging the toner particles, these work functions should be smaller or larger than that of the developer, as this enables the charged toner particles thereof to be given a charge distribution by which a proper development of a latent image is obtained.

Figure 14:
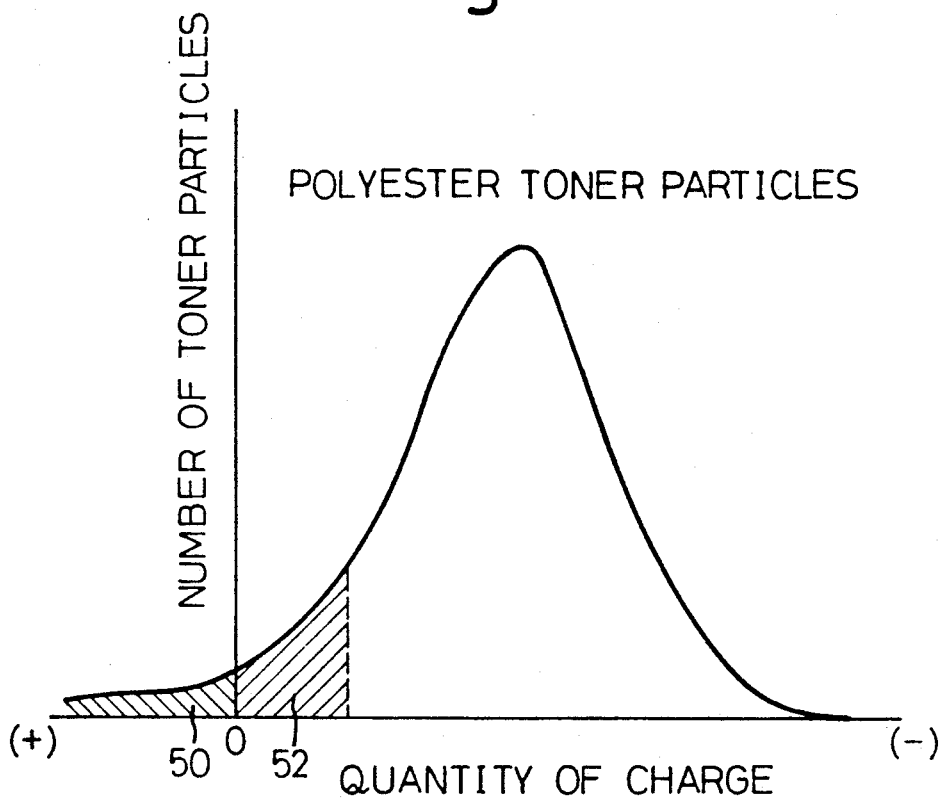
FIG. 14 is a graph showing a charge distribution of the polyester resin-based toner particles when being charged by a triboelectrification while using the conductive open-cell foam polyurethane rubber developing roller and a Teflon-coated rubber blade member.
Figure 15:
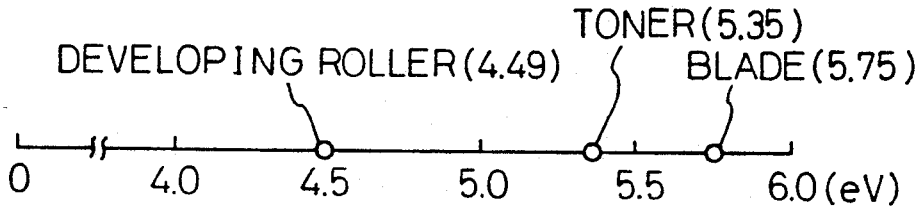
FIG. 15 is a work function scale for comparing the work functions of the conductive open-cell foam polyurethane rubber developing roller, the Teflon-coated rubber blade member, and the polyester resin-based toner particles.

For example, when the polyester resin-based toner particles are charged by using the developing roller formed of the conductive polyurethane foam rubber material and the blade member formed of the Teflon-coated rubber material, the charged polyester resin-based toner particles are given a charge distribution as shown in FIG. 14, which is similar to the charge distribution of FIG. 12. Namely, the polyester resin-based developer charged by using the polyurethane foam rubber developing roller includes a positively-charged part of the toner particles indicated by reference numeral 50, and a low-level negatively-charged part of the toner particles indicated by reference numeral 52. This is assumed to be because a work function of the Teflon-coated rubber blade member is larger than that of the polyester resin-based toner particles, and thus even though the toner particles are negatively charged by the polyurethane foam rubber developing roller, the negative charge of the toner particles is weakened by the blade member having a work function smaller than that of the toner particles, whereby a part of the toner particles can be given a positive charge. In practice, measurements proved that the polyurethane foam rubber developing roller, the polyester resin-based toner particles, and the Teflon-coated rubber blade member have the work functions of 4.49, 5.35, and 5.75 eV, respectively, as shown in FIG. 15.

Figure 16:
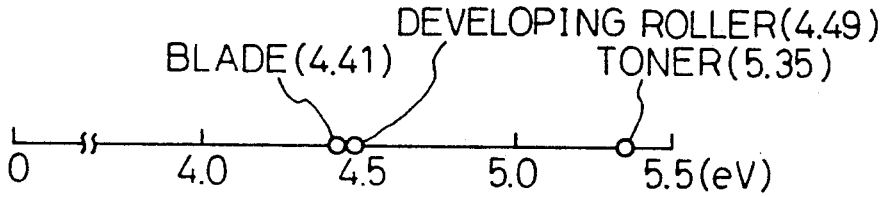
FIG. 16 is a work function scale for comparing the work functions of the conductive open-cell foam polyurethane rubber developing roller, an aluminum blade member, and the polyester resin-based toner particles.
Figure 17:
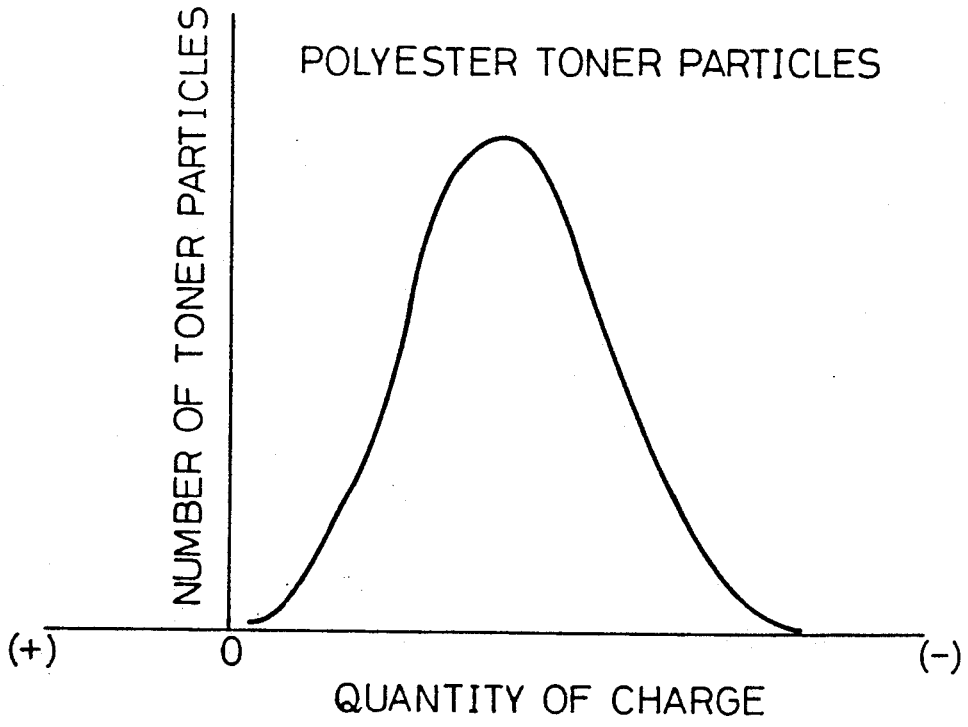
FIG. 17 is a graph showing a charge distribution of the polyester resin-based toner particles when charged by a triboelectrification while using the conductive open-cell foam polyurethane rubber developing roller and the aluminum blade member.

When the toner particles have the charge distribution as shown in FIG. 14, for the same reasons as mentioned above, the developer also may be prematurely consumed and a photographic fog may appear. Nevertheless, these disadvantages can be surmounted by forming the blade member 20 of a metal material having a relatively small work function. For example, when the blade member is formed of aluminum having a work function of 4.41 eV, the work functions of the polyurethane foam rubber developing roller and blade member are less than that of the polyester resin-based toner particles, as shown in FIG. 16, so that the polyester resin-based toner particles can be negatively charged by the polyurethane foam rubber developing roller and the blade member. As a result, the charged polyester resin-based toner particles are given a desired charge distribution, as shown in FIG. 17.

The polyester resin-based toner particles having a work function of 5.35 eV were produced from the following raw materials:

| | |
|---|---|
| (1) polyester resin: (acid values 45; melting point 145° C.) | 93 pbw (parts by weight) |
| (2) carbon: (Black Pearls L: Cabot Corp.) | 3 pbw |
| (3) polypropylene wax: (Biscol 550P: Sanyo Kasei K.K.) | 1 pbw |
| (4) azo dye: (Aizen Spilon Black TRH: Hodogaya Chemical Corp. Ltd.) | 2 pbw |

Note, the polyester resin was obtained by a condensation of terephthalic acid, trimellitic acid, and diol having the structural formula given below:

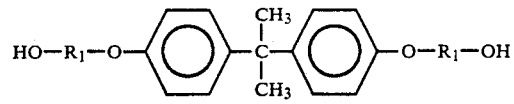

Wherein, $R_1$ is $C_nH_{2n}$ ($1 \leqq n \leqq 5$)

In the production steps, these raw materials were mixed, fused, kneaded, and then powdered to produce fine particles having a diameter of from 5 to 15 μm.

Also, when another type of azo dye (S34: Orient chemical K.K.) was substituted for the azo dye (Aizen Spilon Black TRH: Hodogaya Chemical Corp., Ltd.), the polyester resin-based toner particles obtained had a work function of 5.60 eV, which is larger than the work functions of the polyurethane foam rubber developing roller and the aluminum blade member.

The styrene acrylic resin-based toner particles also can be used, as long as a work function thereof is larger than the work functions of the polyurethane foam rubber developing roller and the aluminum blade member.

In practice, styrene acrylic resin-based toner particles having a work function of 5.25 eV, which is larger than the work functions of the polyurethane foam rubber developing roller and the aluminum blade member, were produced by using the following raw materials:

| | |
|---|---|
| (1) styrene acrylic resin: (melting point 140° C.) | 90 pbw |
| (2) carbon: (Black Pearls L: Cabot Corp.) | 5 pbw |
| (3) polypropylene wax: (Biscol 550P: Sanyo Kasei K.K.) | 3 pbw |
| (4) azo dye: (Aizen Spilon Black TRH: Hodogaya Chemical Corp., Ltd.) | 2 pbw |

Note, the styrene acrylic resin was obtained by a copolymerization of styrene and n-butylacrylate.

In the production steps, these raw materials were mixed, fused, kneaded, and then powdered into fine particles having a diameter of from 5 to 15 μm.

Namely, when the toner particles are to be given a negative charge, the desired charge distribution can be obtained by constituting the developing roller and the blade member in such a manner that the work functions thereof are less than that of the toner particles.

On the other hand, when the toner particles are to be given the positive charge, the desired charge distribution can be obtained by constituting the developing roller and the blade member in such a manner that the work functions thereof are larger than that of the toner particles. For example, polyester resin-based toner particles having a work function of 5.35 eV or styrene acrylic resin-based toner particles having a work function of 5.25 eV can be given a positive charge by using the Teflon-coated rubber blade member having a work function of 5.75 eV and by coating the polyurethane foam rubber developing roller with Teflon to give a work function of 5.75 eV thereto. Note, the Teflon-coating of the developing roller should be carried out in such a manner that the pore openings existing in the surface thereof are not covered.

According to a further aspect of the present invention, the developing device 10 is characterized in that the developing roller 18 and the developer D are constituted in such a manner that the triboelectrification therebetween does not participate in the charging of the toner particles, as much as possible, because the triboelectrification therebetween is affected by variations in the environment, particularly temperature and air moisture content changes, and thus although the work functions of the developing roller and the blade member are smaller or larger than that of the developer as mentioned above, the charged toner particles cannot be always given the desired charge distribution.

For example, when using the aluminum blade member, the polyurethane foam rubber developing roller, and the polyester resin-based toner particles, having the work functions of 4.41, 4.49, and 5.60 eV as shown in FIG. 18, a charge distribution of the toner particles is easily changed by a variation of the temperature and air moisture content, as shown in FIGS. 19(*a*), 19(*b*), and 19(*c*). Namely, when the temperature and air moisture content are 5° C. and 20%, respectively, the toner particles are given a charge distribution as shown in FIG. 19(*a*), but when the temperature and air moisture content are raised from 5° C. and 20% to 25° C. and 50%, respectively, the charge distribution of the toner particles is shifted toward the positive side, as shown in FIG. 19(*b*), and when the temperature and air moisture content are raised to 32° C. and 80%, respectively, the charge distribution of the toner particles is further shifted toward the positive side, as shown in FIG. 19(*c*). This is assumed to be because the water contents of the developing roller and the toner particles are changeable in response to variations of the temperature and air moisture content. The charge distributions shown in FIGS. 19(*a*) and 19(*b*) ensure a proper development of a latent image, but the charge distribution shown in FIG. 19(*c*) does not, because the toner particles include positively-charged and low-level negatively charged parts, as shown by the hatchings in FIG. 19(*c*).

Accordingly, when the electrophotographic printer is used under high temperature and air moisture content conditions, the developing roller and the developer should be constituted in such a manner that the triboelectrification therebetween does not participate in the charging of the toner particles, as much as possible. This can be carried out by ensuring that the work functions of the developing roller and the developer conform with each other as much as possible. For example, by coating the polyurethane foam rubber developing roller with Teflon, it can be given the work function of 5.75 eV, as mentioned above, which is approximate to the work function of 5.60 eV as shown in FIG. 20. In this case, the charging of the toner particles may be actively carried out by the aluminum blade member having the work function of 4.41 eV, so that a charge distribution thereof is relatively stable regardless of variations of the temperature and air moisture content, as shown in FIGS. 21(*a*), 21(*b*), and 21(*c*). In particular, as apparent from these drawings, the charge distribution may be shifted slightly to the positive side in response to a raise in the temperature and air moisture content, but even though the temperature and air moisture content are raised to 32° C. and 80%, respectively, the charge distribution does not include positively charged toner particles.

Furthermore, according to the present invention, the developing roller 18, the blade member 20, and the developer may be constituted in such a manner that the work functions thereof approximate each other, whereby the triboelectrification between the developing roller and blade member and the toner particles does not participate in the charging of the toner particles, as much as possible. In this case, the charging of the toner particles is carried out by the charge-injection effect resulting from the application of a bias voltage to the conductive blade member 20. For example, by coating the polyurethane foam rubber developing roller and the conductive rubber blade member with Teflon, and by using the polyester resin-based toner particles having the work function of 5.60 eV, the work functions thereof may approximate each other because the polyurethane foam rubber developing roller and the conductive rubber blade member can be given the work function of 5.75 eV by the Teflon coating, as mentioned above. When the work functions of the developing roller 18, the blade member 20, and the developer approximate each other, the charging of the toner particles can be substantially protected from the affect of variation of the temperature and air moisture content, and thus the charge distribution of the toner particles is made more stable. Note, in practice, it is possible to give a charge of $-10\pm1$ μq/g to the toner particles when a bias voltage of $-200$ V is applied to the blade member.

According to the present invention, the charge-injection effect may be utilized in cooperation with the triboelectrification for charging the toner particles. When the charge-injection effect is utilized for charging the toner particles, a difference between the bias voltage applied to the blade member and the developing bias voltage applied to the developing roller should be within a predetermined range, because when the difference is small enough to allow the electrostatical adhesion of the toner particles to the blade member, an even formation of the developer layer around the developing roller may not be possible, and because when the difference is large enough to cause a high electrical current or an electrical discharge between the blade member and the developing roller, not only the toner particles but also the developing roller may be fused due to a generation of Joule heat. For example, when the polyurethane foam rubber developing roller, the aluminum blade member, and the polyester resin based toner particles are used, the difference between the bias voltage applied to the blade member and the developing bias voltage applied to the developing roller should be within the range of from −20 to −200 volts, as shown in the following Table.

| Voltage of Blade | Voltage Difference between Blade and Roller | Changes at Roller | Changes at Blade |
|---|---|---|---|
| −650 V | −350 V | Recesses Formed in Roller Surface by Fusion | Fused Toner Adhered to Blade |
| −600 V | −300 V | Fused Toner Adhered Like Film to Roller: Developing Density Lowered | None |
| −550 V | −250 V | Fused Toner Adhered Like Film to Roller: Developing Density Lowered | None |
| −500 V | −200 V | Fused Toner Slightly Adhered Like Film to Roller: Developing Density Not Lowered | None |
| −450 V | −150 V | Fused Toner Slightly Adhered Like Film to Roller: Developing Density Not Lowered | None |
| −400 V | −100 V | None | None |
| −370 V | −70 V | None | None |
| −350 V | −50 V | None | None |
| −330 V | −30 V | None | None |
| −320 V | −20 V | None | None |
| −310 V | −10 V | None | Toner Electrostatically Adhered to Blade |
| −300 V | 0 V | None | Toner Electrostatically Adhered to Blade |

As apparent from the Table, when the voltage difference is more than −350 volts, not only the toner particles but also the developing roller are fused due to the discharge between the blade member and the developing roller, so that recesses are formed in the surface thereof. When the voltage difference is between −300 and −250 volts, the formation of the recesses can be prevented at the surface of the developing roller, but the fused toner particles are adhered like a film to the surface thereof so that the toner density of the development is lowered. When the voltage difference is between −200 and −150 volts, the fused toner particles are slightly adhered like a film to the surface of the developing roller, but the toner density of the development is not substantially affected thereby. When the voltage difference is less that −10 volts, the toner particles are electrostatically adhered to the blade member. Accordingly, when the polyurethane foam rubber developing roller, the aluminum blade member, and the polyester resin based toner particles are used, the voltage difference should be from −20 to −200 volts, preferably from −20 to −100 volts.

Another embodiment of the developing device for the non-magnetic type one-component developer is shown in FIG. 22, in which elements similar to those of FIG. 1 are indicated by the same reference numerals, and elements corresponding to those of FIG. 1 are indicated by the same reference numerals plus a prime. In FIG. 22, the photosensitive drum 14, the developing roller 18, and the toner-removing roller 24 are constituted in the same manner as in FIG. 1, and the developing roller 18 is pressed against the photosensitive drum 14 at a given linear pressure by resiliently biasing the casing 12 toward the drum 14, so that the given contact or nip width can be obtained therebetween. The blade member 20' also may be arranged in the same manner as in FIG. 1, but is diametrically engaged with the developing roller 18 so that it is resiliently pressed thereagainst to regulate the thickness of the developer layer formed around the developing roller 18. Note, in FIG. 1, the blade member 20 is tangentially engaged with the developing roller 18. The developing device of FIG. 22 is provided with a fur brush roller 26', instead of the paddle roller 26, which moves the toner particles toward the developing roller 18 and is rotated in the same direction as the developing roller 18. When the developing bias voltage of −500 volts is applied to the developing roller 18, a voltage of, for example, −600 volts, which is lower than the developing bias voltage, is applied to the fur brush roller 26', whereby the toner particles entrained by the fur brush roller 26' are electrostatically adhered to the developing roller 18.

FIG. 23 shows a modification of the embodiment shown in FIG. 22. This is identical to the developing device of FIG. 22 except that a roller member 54 is used, instead of the blade member 20', to regulate the thickness of the developer layer formed around the developing roller 18. Similar to the blade member 20, the roller member 54 may be formed of a non-conductive or conductive rubber material, and preferably is coated with Teflon, and further, may be formed of a suitable metal material such as aluminum, stainless steel, brass or the like. The roller member 54 is rotated in the same direction as the developing roller 18. In this modified embodiment, by varying a peripheral speed of the roller member 54 with respect to a peripheral speed of the developing roller 18, not only can the thickness of the developer layer be easily regulated, but also the triboelectrification can be caused between the roller member 54 and the developing roller 18.

FIG. 24 shows a further embodiment of the developing device for the non-magnetic type one-component developer. In this embodiment, the photosensitive drum 14 and the developing roller 18 are constituted in the same manner as in FIG. 1, but are rotated in the opposite directions, as indicated by arrows $A_8$ and $A_9$. In particular, the developing device of the FIG. 24 is characterized in that, during the rotation of the drum 14 and developing roller 18, the surfaces thereof move upward at the developing area where they are pressed against each other. Note, in the embodiments mentioned above, the drum and developing roller are rotated so that the surfaces thereof move downward at the developing area. The developing device of the FIG. 24 is also characterized in that the blade member 20, which may be constituted in the same manner as in FIG. 1, is positioned below the developing roller 18, to prevent a leakage of the toner particles from a space between the developing roller 18 and a bottom of the vessel 16, and that the bottom of the vessel 16 forms a steep slope descending toward the developing roller 18, so that the toner particles can be moved thereto by the force of gravity. Namely, according to this embodiment, it is possible to omit the toner-removing roller 24, the paddle roller 26 or fur brush roller 26', and the agitator 28, whereby the developing device can be given a compact construction. Note, the toner-removing roller may be incorporated into the embodiment of FIG. 34, if necessary. Further note, in FIG. 34, reference numeral 56 designates a portion of a frame structure of the electrophotographic printer, from which the casing 12 is suspended through the intermediary of guide roller elements 58 so that it can be moved toward and away from the photosensitive drum 14, whereby the developing roller 18 can be resiliently pressed thereagainst.

FIG. 25 shows, by way of example, an electrophotographic color printer having three developing devices 10Y, 10M, and 10C according to the present invention incorporated therein. These developing devices 10Y, 10M, and 10C are identical, and each device is arranged in substantially the same manner as the developing device of FIG. 1. Accordingly, in FIG. 25, elements similar to those of the developing device shown FIG. 1 are indicated by the same reference numerals. Namely, the developing devices 10Y, 10M, and 10C are distinguished from each other only in that yellow, magenta, and cyan non-magnetic type one-component developers are used in the developing devices 10Y, 10M, and 10C, respectively. Each of the developing devices 10Y, 10M, and 10C is supported in such a manner that it is movable between a developing position at which the developing roller 18 is resiliently pressed against the photosensitive drum 56 and a non-developing position at which the developing roller 18 is retracted from the developing position. Note, in FIG. 25, the developing device 10M is at the developing position, and the developing devices 10Y and 10C are both at the non-develop position.

As shown in FIG. 25, the color printing also comprises a photosensitive drum 56 having a larger diameter than that of the photosensitive drum 14, due to the arrangement of the three developing devices 10Y, 10M, and 10C therearound, and having the organic photoconductor (OPC) film as the photosensitive film. The color printer also comprises a charger 58, which may be a corona discharger, for producing a uniform distribution of negative charges on the photosensitive drum 56, and a laser beam scanner 60 for writing an electrostatic latent image on the charged area of the photosensitive drum 56. The laser beam scanner 60 includes a laser beam generator **60*a* such as a semiconductor laser device for emitting a laser beam LB, and a polygon mirror 60*b* for deflecting the laser beam LB to scan the drum surface with the deflected laser beam. During the scanning operation, the laser beam LB is intermittently emitted on the basis of color (yellow, magenta, and cyan) video data obtained from a word processor, a microcomputer or the like, whereby the electrostatic latent image is formed as a dot image on the drum surface. The electrostatic latent images formed on the basis of the yellow, magenta, and cyan video data are developed by the developing devices 10Y, 10M, and 10C**, respectively.

The color printer further comprises a transfer drum 62, which may be made of a mesh metal sheet material, disposed in the vicinity of the photosensitive drum 56. The transfer drum 62 and the photosensitive drum 56 are rotated in reverse directions with respect to each other, as indicated by arrows $A_{10}$ and $A_{11}$ in FIG. 25. The transfer drum 62 is provided with a transfer charger **62*a*, which may be a corona discharger, disposed inside thereof and facing the rotating photosensitive drum 56 through the intermediary of the rotating transfer charger 62*a*. The color printer also comprises two sheet supply trays 64 and 66 in which two stacks of sheets or papers having different sizes, such as B5 and A4, are received, respectively. The sheet supply trays 64, 66 are provided with a pickup rollers 64*a*, 66*a* by which a sheet or paper having a given size (B5, A4) is drawn out one by one therefrom. For example, the A4 paper drawn out from the tray 66 is moved toward a pair of feed rollers 68, by which the paper is then fed to the transfer drum 62. The transfer drum 62 is provided with suitable gripper elements (not shown) for holding the fed paper around the surface thereof. The transfer charger 62*a* gives a positive charge to the paper held by the transfer drum 62, whereby the developed (yellow, magenta, and cyan) image is electrostatically transferred from the photosensitive drum 62 to the paper. The residual toner particles not transferred to the paper are removed from the surface of the photosensitive drum 62 by a cleaner 70 having a pair of fur brush rollers 70*a*, and the cleaned surface of the drum 62 is illuminated by a lamp 72, to eliminate the charge therefrom, and then given a negative charge by the charger 58 to again produce a uniform distribution of the negative charge thereon. Note, reference 73 indicates a travel path of the paper between the sheet supply trays 64 and 66 and the transfer drum 62**.

In the color printing operation of the color printer, for example, first an electrostatic latent image is written on the charged area of the photosensitive drum 56 by the laser beam scanner 60, on the basis of the yellow color video data obtained from a word processor, a microcomputer or the like, and is then developed with the yellow color developer of the developing device 10Y moved to the developing position; the developing devices 10M and 10C being at the non-developing position. Thereafter, the yellow color developed toner image is transferred by the transfer charger **62*a* to the paper held by the transfer drum. Successively, an electrostatic latent image is written on the charged area of the photosensitive drum 56 by the laser beam scanner 60 on the basis of the magenta color video data, and is then developed with the magenta color developer of the developing device 10M moved to the developing position; the developing devices 10Y and 10C being at the non-developing position. Thereafter, the magenta color developed image is transferred by the transfer charger 62*a* to the paper held by the transfer drum 62, so that the magenta color transferred image is superimposed on the yellow color image transferred to the paper held by the transfer drum 62. Furthermore, an electrostatic latent image is written on the charged area of the photosensitive drum 56 by the laser beam scanner 60 on the basis of the cyan color video data, and is then developed with the cyan color developer of the developing device 10C moved to the developing position; the developing devices 10Y and 10M being at the non-developing position. Thereafter, the cyan color developed image is transferred by the transfer charger 62a to the paper held by the transfer drum 62, so that the cyan color transferred image is superimposed on the yellow and magenta color images transferred to the paper held by the transfer drum 62**, whereby a multi-color image can be obtained on the paper.

The paper carrying the multi-color image is then conveyed from the transfer drum 62 toward a toner image fixing device 74 including a heat roller 74a and a backup roller 74b. In particular, the toner particles forming the multi-color image are heat-fused by the heat roller 74a so that the multi-color image is heat-fixed on the paper. The paper carrying the fixed image is then moved to a paper-receiving tray 76 by a pair of feed rollers 78. Note, in FIG. 25, reference numerals 78 and 80 indicate a guide member and a conveyer belt forming a travel path of the paper between the transfer drum 62 and the toner image fixing device 74.

Although the embodiments of the present invention are explained in relation to a photosensitive drum, they can be also applied to a dielectric drum on which the electrostatic latent image can be formed. Further, although the developing device according to the present invention is used for the non-magnetic type one-component developer, the magnetic type one-component developer may be also used, if necessary.

Finally, it will be understood by those skilled in the art that the foregoing description is of preferred embodiments of the present invention, and that various changes and modifications can be made thereto without departing from the spirit and scope thereof.

We claim:

1. A developing device using a one-component developer, said developing device comprising:

a vessel for holding a one-component developer composed of toner particles;

a developing roller rotatably provided within said vessel in such a manner that a portion of said developing roller is exposed therefrom and faces a surface of an electrostatic latent image carrying body; and said developing roller formed of a monolithic conductive open-cell foam elastic material, an outside peripheral surface of said conductive open-cell foam elastic material thermally or chemically fused to prevent a penetration of the toner particles to an open-cell foam structure of said developing roller.

2. A developing device as set forth in claim 1, wherein said conductive open-cell foam elastic material of which said developing roller is formed is selected from a group consisting of a conductive open-cell foam polyurethane rubber material, a conductive open-cell foam silicone rubber material, and a conductive open-cell foam acrylonitorile-butadiene rubber material.

3. A developing device as set forth in claim 1, wherein said developing roller is resiliently pressed against the surface of said electrostatic latent image carrying body, and has an Asker C-hardness of at most 50°, preferably 35°, whereby an operating life of said electrostatic latent image carrying body can be prolonged.

4. A developing device as set forth in claim 1, further comprising a developer layer regulating means provided within said vessel and resiliently engaged with said developing roller for regulating a thickness of the developer layer formed around said developing roller, said developing roller having an Asker C-hardness of at most 50°, preferably 35°, said developer layer regulating means being formed of a metal material selected from a group consisting of aluminum, stainless steel, and brass, whereby variations of the developer layer thickness regulated by said developer layer regulating means can be reduced.

5. A developing device as set forth in claim 1, wherein said conductive open-cell foam elastic material of which said developing roller is formed is a conductive open-cell foam polyurethane rubber material which is neutral with regard to frictional electrification, whereby the toner particles can be given a desired charge distribution by utilizing a triboelectrification between said developing roller and the toner particles.

6. A developing device using a one-component developer, said developing device comprising:

a vessel for holding a one-component developer composed of toner particles;

a developing roller rotatably provided within said vessel in such a manner that a portion of said developing roller is exposed therefrom and faces a surface of an electrostatic latent image carrying body;

a developing roller formed of a monolithic conductive open-cell foam elastic material, a surface of said developing roller thermally or chemically treated to prevent a penetration of the toner particles to an open-cell foam structure of said developing roller; and a developer roller regulating means provided within said vessel and resiliently engaged with said developing roller for regulating a thickness of the developer layer formed around said developing roller, wherein when the toner particles are charged by a triboelectrification between said developing roller and developer layer regulating means and the toner particles, said developing roller and developer layer regulating means are constituted in such a manner that a relationship of work functions $W_1$ and $W_2$ thereof and a work function $W_3$ of the toner particles is defined by the following formula:

$$(W_1-W_3)\times(W_2-W_3)>0$$

wherein the toner particles can be given a desired distribution.

7. A developing device as set forth in claim 6, wherein said conductive open-cell foam elastic material of which said developing roller is formed is selected from a group consisting of a conductive open-cell foam polyurethane rubber material, a conductive open-cell foam silicone rubber material, and a conductive open-cell foam acrylonitorile-butadiene rubber material.

8. A developing device as set forth in claim 6, wherein said developing roller is resiliently pressed against the surface of said electrostatic latent image carrying body, and has an Asker C-hardness of at most 50°, preferably 35°, whereby an operating life of said electrostatic latent image carrying body can be prolonged.

9. A developing device as set forth in claim 6, wherein said developing roller having an Asker C-hardness of at most 50°, preferably 35°, and said developer layer regulating means is formed of a metal material selected from a group consisting of aluminum, stainless steel, and brass, whereby variations of the developer layer thickness regulated by said developer layer regulating means can be reduced.

10. A developing device as set forth in claim 6, wherein said developer layer regulating means comprises a blade member resiliently pressed against said developing roller.

11. A developing device as set forth in claim 10, wherein said blade member is positioned below said developing roller to prevent a leakage of the toner particles from a space between said developing roller and a bottom of said vessel.

12. A developing device as set forth in claim 6, wherein said developer layer regulating means comprises a roller member resiliently pressed against said developing roller.

13. A developing device using a one-component developing, said developing device comprising:

a vessel for holding a one-component developer composed of toner particles;

a developing roller rotatably provided within said vessel in such a manner that a portion of said developing roller is exposed therefrom and faces a surface of an electrostatic latent image carrying body;

said developing roller formed of a monolithic conductive open-cell foam elastic material, a surface of said developing roller is thermally or chemically treated to prevent a penetration of the toner particles to an open-cell foam structure of said developing roller; and a developer layer regulating means is provided within said vessel and resiliently engaged with said developing roller for regulating a thickness of the developer layer formed around said developing roller, wherein said developing roller is constituted so that a work function thereof approximates, preferably conforms with, that of the toner particles, and the toner particles are charged by a triboelectrification between said developer layer regulating means and the toner particles, wherein the toner particles can be given a desired charge distribution regardless of variations of temperature and air moisture content.

14. A developing device as set forth in claim 13, wherein said conductive open-cell foam elastic material of which said developing roller is formed is selected from a group consisting of a conductive open-cell foam polyurethane rubber material, a conductive open-cell foam silicone rubber material, and a conductive open-cell foam acrylonitorile-butadiene rubber material.

15. A developing device as set forth in claim 13, wherein said developing roller is resiliently pressed against the surface of said electrostatic latent image carrying body, and has an Asker C-hardness of at most 50°, preferably 35°, whereby an operating life of said electrostatic latent image carrying body can be prolonged.

16. A developing device as set forth in claim 13, wherein said developing roller having an Asker C-hardness of at most 50°, preferably 35°, and said developer layer regulating means is formed of a metal material selected from a group consisting of aluminum, stainless steel, and brass, whereby variations of the developer layer thickness regulated by said developer layer regulating means can be reduced.

17. A developing device as set forth in claim 13, wherein said developer layer regulating means comprises a blade member resiliently pressed against said developing roller.

18. A developing device as set forth in claim 17, wherein said blade member is positioned below said developing roller to prevent a leakage of the toner particles from a space between said developing roller and a bottom of said vessel.

19. A developing device as set forth in claim 13, wherein said developer layer regulating means comprises a roller member resiliently pressed against said developing roller.

20. A developing device using a one-component developer, said developing device comprising:

a vessel for holding a one-component developer composed of toner particles;

a developing roller rotatably provided within said vessel in such a manner that a portion of said developing roller is exposed therefrom and faces a surface of an electrostatic latent image carrying body;

said developing roller being formed of a monolithic conductive open-cell foam elastic material, a surface of said developing roller is thermally or chemically treated to prevent a penetration of the toner particles to an open-cell foam structure of said developing roller; and a developer layer regulating means provided within said vessel and resiliently engaged with said developing roller for regulating a thickness of the developer layer formed around said developing roller, wherein said developer layer regulating means is formed of a conductive material for applying a bias voltage thereto preventing the toner particles from being electrostatically adhered to said developer layer regulating means; and when a charge-injection effect regulating from an application of the bias voltage to said developer layer regulating means is utilized for charging the toner particles, a difference between the bias voltage applied to said developer layer regulating means and a developing bias voltage applied to said developing roller is less than a level at which a high electrical current or an electrical discharge occurs between said developer layer regulating means and said developing means.

21. A developing device as set forth in claim 20, wherein said conductive open-cell foam elastic material of which said developing roller is formed is selected from a group consisting of a conductive open-cell foam polyurethane rubber material, a conductive open-cell foam silicone rubber material, and a conductive open-cell foam acrylonitorile-butadiene rubber material.

22. A developing device as set forth in claim 20, wherein said developing roller is resiliently pressed against the surface of said electrostatic latent image carrying body, and has an Asker C-hardness of at most 50°, preferably 35°, whereby an operating life of said electrostatic latent image carrying body can be prolonged.

23. A developing device as set forth in claim 20, wherein said developing roller having an Asker C-hardness of at most 50°, preferably 35°, and said developer layer regulating means is formed of a metal material selected from a group consisting of aluminum, stainless steel, and brass, whereby variations of the developer layer thickness regulated by said developer layer regulating means can be reduced.

24. A developing device as set forth in claim 20, wherein said developer layer regulating means comprises a blade member resilient pressed against said developing roller.

25. A developing device as set forth in claim 24, wherein said blade member is positioned below said developing roller to prevent a leakage of the toner particles from a space between said developing roller and a bottom of said vessel.

26. A developing device as set forth in claim 20, wherein said developer layer regulating means comprises a roller member resiliently pressed against said developing roller.

27. A developing device using a one-component developer, said developing device comprising:

a vessel for holding a one-component developer composed of toner particles;

a developing roller rotatably provided within said vessel in such a manner that a portion of said developing roller is exposed therefrom and faces a surface of an electrostatic latent image carrying body;

said developing roller being formed of a monolithic conductive open-cell foam elastic material in such a manner that pore openings appear over an outside peripheral surface thereof, a size of said pore openings being smaller than that of cellular pores inside of said developing roller, to thereby prevent a penetration of the toner particles into an open-cell foam structure of said developing roller.

28. A developing device as set forth in claim 27, wherein said monolithic conductive open-cell foam elastic material of which said developing roller is formed is selected from a group consisting of a conductive open-cell foam polyurethane rubber material, a conductive open-cell foam silicon rubber material, and a conductive open-cell foam acrylonitorile-butadiene rubber material.

29. A developing device as set forth in claim 27, wherein said developing roller is resiliently pressed against the surface of said electrostatic latent image carrying body, and has an Asker C-hardness of at most 50°, preferably 35°, whereby an operating life of said electrostatic latent image carrying body can be prolonged.

30. A developing device as set forth in claim 27, further comprising a developer layer regulating means provided within said vessel and resiliently engaged with said developing roller for regulating a thickness of the developer layer formed around said developing roller, said developing roller having an Asker C-hardness of at most 50°, preferably 35°, said developer layer regulating means being formed of a metal material selected from a group consisting of aluminum, stainless steel, and brass, whereby variations of the developer layer thickness regulated by said developer layer regulating means can be reduced.

31. A developing device as set forth in claim 27, wherein said monolithic conductive pen-cell foam elastic material of which said developing roller is formed is a conductive open-cell foam polyurethane rubber material which is neutral with regard to frictional electrification, whereby the toner particles can be given a desired charge distribution by utilizing a triboelectrification between said developing roller and the toner particles.

* * * * *

UNITED STATES PATENT AND TRADEMARK OFFICE

CERTIFICATE OF CORRECTION

PATENT NO. : 5,062,385

DATED : November 5, 1991

INVENTOR(S) : Yukio NISHIO et al

It is certified that error appears in the above-identified patent and that said Letters Patent is hereby corrected as shown below:

On the cover page, Item [75], first line, "Kazonori" should read -- Kazunori --.

Signed and Sealed this

Twentieth Day of April, 1993

*Attest:*

MICHAEL K. KIRK

*Attesting Officer*

*Acting Commissioner of Patents and Trademarks*